US009863206B2

(12) United States Patent
Biester et al.

(10) Patent No.: US 9,863,206 B2
(45) Date of Patent: Jan. 9, 2018

(54) BLOWOUT PREVENTER STACK AND SUPPLY SYSTEM

(71) Applicants: Klaus Biester, Wienhausen (DE); Peter Kunow, Berlin (DE)

(72) Inventors: Klaus Biester, Wienhausen (DE); Peter Kunow, Berlin (DE)

( * ) Notice: Subject to any disclaimer, the term of this patent is extended or adjusted under 35 U.S.C. 154(b) by 0 days.

(21) Appl. No.: 14/912,808

(22) PCT Filed: Aug. 29, 2014

(86) PCT No.: PCT/EP2014/068453

§ 371 (c)(1),
(2) Date: Feb. 18, 2016

(87) PCT Pub. No.: WO2015/028651

PCT Pub. Date: Mar. 5, 2015

(65) Prior Publication Data

US 2016/0201423 A1 Jul. 14, 2016

Related U.S. Application Data

(60) Provisional application No. 61/872,119, filed on Aug. 30, 2013.

(30) Foreign Application Priority Data

Aug. 30, 2013 (DE) ..... 10 2013 217 383

(51) Int. Cl.
*E21B 33/064* (2006.01)
*E21B 33/035* (2006.01)
(Continued)

(52) U.S. Cl.
CPC ..... *E21B 33/064* (2013.01); *E21B 33/0355* (2013.01); *E21B 33/063* (2013.01); *E21B 34/16* (2013.01); *E21B 47/12* (2013.01)

(58) Field of Classification Search
CPC .. E21B 33/064; E21B 33/063; E21B 33/0355; E21B 34/16; E21B 47/12
See application file for complete search history.

(56) References Cited

U.S. PATENT DOCUMENTS 3,667,721 A 6/1972 Vujasinovic
5,655,745 A 8/1997 Morrill
(Continued)

FOREIGN PATENT DOCUMENTS

CN 201 588 594 U 9/2010
GB 2266546 A * 11/1993 ..... E21B 33/0355
(Continued)

*Primary Examiner* — Matthew R Buck
(74) *Attorney, Agent, or Firm* — Ware, Fressola, Maguire & Barber LLP

(57) ABSTRACT

The invention relates to a blowout preventer stack comprising blowout preventer stack components. A part of the blowout preventer stack components has a blowout preventer with an electric blowout preventer drive means for operating the blowout preventer. The energy necessary for operating the blowout preventer is provided by kinetic energy storage devices. The kinetic energy storage devices are flywheel energy storage devices, which serve as motor-generator-combination and store, provide and receive kinetic energy and exchange it into electric energy. A steam turbine arrangement and further emergency energy supply and emergency control systems serving as emergency energy supply system are connected to the blowout preventer stack and can be operated parallel to energy supply and control systems. This facilitates a multi-redundant energy supply and control system with upmost effectiveness as to fail-safety of the blowout preventer stack.

17 Claims, 30 Drawing Sheets

(51) Int. Cl.

| | |
|---|---|
| ***E21B 33/06*** | (2006.01) |
| ***E21B 47/12*** | (2012.01) |
| ***E21B 34/16*** | (2006.01) |

(56) References Cited

U.S. PATENT DOCUMENTS

| | | | | |
|---|---|---|---|---|
| 6,719,042 | B2 | 4/2004 | Johnson et al. | |
| 6,998,724 | B2 * | 2/2006 | Johansen | E21B 33/0355 166/65.1 |
| 7,025,322 | B2 * | 4/2006 | Biester | E21B 33/062 251/1.3 |
| 7,300,033 | B1 | 11/2007 | Whitby et al. | |
| 8,759,993 | B2 * | 6/2014 | Coonrod | F03G 7/08 290/1 R |
| 8,779,614 | B2 * | 7/2014 | Yarnold | E21B 41/0085 290/54 |
| 8,789,606 | B1 * | 7/2014 | Lugo | E21B 33/0355 166/250.15 |
| 8,997,875 | B2 * | 4/2015 | Bennett | H01M 6/36 166/351 |
| 2008/0047753 | A1 | 2/2008 | Hall et al. | |
| 2012/0088134 | A1 * | 4/2012 | Wood | E21B 33/064 429/90 |
| 2012/0197527 | A1 * | 8/2012 | McKay | E21B 41/0007 702/6 |
| 2013/0153242 | A1 * | 6/2013 | Flight | E21B 33/0355 166/363 |
| 2014/0131049 | A1 * | 5/2014 | Bourgeau | E21B 33/0355 166/363 |

FOREIGN PATENT DOCUMENTS

| | | | |
|---|---|---|---|
| WO | 02/36933 | A1 | 5/2002 |
| WO | 2003/049249 | A1 | 6/2003 |
| WO | 2013/119126 | A1 | 8/2013 |

* cited by examiner

Picture 5

BLOWOUT PREVENTER STACK AND SUPPLY SYSTEM

CROSS REFERENCE TO RELATED APPLICATIONS

This application is the U.S. National Stage of International Application Number PCT/EP2014/068453 filed on Aug. 29, 2014 which application claims priority under 35 USC §119 to German Patent Application No. 102013217383.0 filed on Aug. 30, 2013 and to U.S. Provisional Patent Application No. 61/872,119 filed on Aug. 30, 2013. All of these applications are hereby incorporated by reference in their entirety.

TECHNICAL FIELD

The invention relates to a blowout preventer stack comprising blowout preventer stack components having electrical blowout preventer drive means for driving at least one respective blowout preventer (BOP) and with at least one kinetic energy storage device for energy supply and energy storage.

BACKGROUND OF THE INVENTION

Typically, drill strings made up of drill rods are used for deep drilling in order to reach subterranean natural oil and/or gas deposits. At the end of the drill string, a drill head for grindingly comminuting the soil is provided, for instance a roller bit or a diamond bit (PDC bit). The drill rods have a free inner diameter of ca. 51 mm (2 in) to ca. 1.22 m (48 in) and lengths of typically 9.1 m (30 ft) or ca. 14 m (46 ft). The drill string is assembled of joined drill rods. The diameter of the drill rods of the drill string currently used for drilling depends on the drilling depth. The drill rods are secured by joints, so that hundreds of drill rods must be connected with each other to reach depths of thousands of meters. A maximum depth of up to ca. 12,000 m below ground can be attained thereby. At the inlet of the well, a concrete foundation is cast to secure the well. From the well protrudes a portion of the drill string which is connected to a derrick crane or the so-called derrick, respectively, to hold the drill string and possibly also to drive it for example by means of a top drive. During drilling, holes of different size and depth are drilled, into which a respective pipe casing is inserted and a cylinder-ring shaped concrete wall to secure the well is cast, in order to hold the drill rods in position and guide them. Furthermore, the pipe casings serve also to prevent rock material from falling off or to prevent the intrusion of groundwater. Typically, a well consists of multiple pipe strings of different diameters and lengths. In that respect the pipe string diameters decrease from near-surface depths towards greater depths.

During the drilling process, the drill head grindingly comminutes the rock material which is generally below it. Typically, the rock material is pumped along the free cylindrical ring-shaped shaft extending around the drill rods from the end of the well to the inlet of the well. For that purpose, a jetting liquid, typically water/oil with clay and/or barytes, is pumped through the drill rods under high working pressure of up to ca. 2,000 bar (30,000 psi), which issues at the drill head and forces the rock material (upwardly) towards the well inlet. Thereby, the jetting liquid serves for stabilizing the well, cooling and lubricating the drill head, removing rock material and removing the rock material from the well extremity.

Due to mankind's high demand for crude oil and natural gas, the necessity for exploiting deeper and deeper and/or very difficult attainable reserves increases, so that nowadays the extraction of crude oil/natural gas from reserves at depths of 2,000 m to 4,000 m below ground is typical. In particular, drillings on the sea bottom (subsea drilling), which are undertaken from drilling vessels or offshore platforms/drilling islands, are applied to exploit new crude oil and/or natural gas resources. Compared to depth drillings on land, depth drillings on the sea bottom lead to major technical difficulties, because the beginning of the well can already be as deep as 4,500 m (15,000 ft) below sea level. At such a great depth, a direct human access is not possible, so that generally remote-controlled systems must be applied. Those are error-prone and their replacement requires a high expenditure of time. Further, due to the saline seawater and higher pressure conditions prevailing on the sea bottom, the deterioration of mechanical parts which are necessary for the drilling process increases. The mechanical parts are subject to accelerated corrosion and/or wear and tear. Drillings are also undertaken in fresh-water lakes, however, they are less common than depth drillings on the sea bottom and serve mainly for research purposes and not for the exploitation of oil deposits and/or natural gas deposits.

The drilling process and also the operation of a well bear the danger of a blowout, i.e. the uncontrolled ejection of material, like e.g. oil, gas, soil, water, rocks or other material, if for instance a rapid pressure change occurs during the drilling or operation of the well. This occurs particularly during the drilling process when the drill head expands into oil deposits or gas deposits. In order to prevent a blowout which leads to severe ecological damage and waste of resources, it is the practice to use blowout preventers (BOP).

Blowout preventers (BOPs) are known from the prior art and serve for pressure adjustment and for covering a well in the case of a blowout. Typically, a stack made up of different blowout preventers is positioned at the ground-level beginning of the well. The blowout preventer stacks can weigh up to 1000 t and reach heights of up to 20 m. Blowout preventer stacks generally comprise pressure pipes which can exert pressure on the material in the well or relieve pressure from the well in order to regulate the pressure in the well and thereby e.g. permit controlled drilling or exploitation of oil and/or gas from the well. Various kinds of blowout preventer stacks are used during drilling the well and during the exploitation via the well. The blowout preventers for the drilling have a working time of ca. 6 months and are subject to checking after that time. In the case of deep sea drillings, the entire blowout preventer stack must be transported for that purpose from the sea bottom to the sea surface. For extraction, also a simpler construction can be used, for instance a Christmas tree/production tree. Christmas trees have much longer working times of up to 25 years. The arrangement and the number of blowout preventers in a blowout preventer stack determines the maximum drilling depth, because typically an adjusted blowout preventer for each pipe diameter used during drilling is available in the blowout preventer stack.

Blowout preventers can be in the form of ram blowout preventers or annular blowout preventers. Ram blowout preventers typically comprise two oppositely arranged rams, jaws or valves, which are displaceable relative to each other. Annular blowout preventers typically include an annular elastic element, which can have a plurality of ring segments which are possibly reinforced by metal segments and which are displaceable so that they can form a hermetic sealing by their contacting surfaces. Depending on the design, and particularly depending on the kind of jaws, ram blowout preventers can serve for cutting through, sealing or impressing a drill rod of the drill string extending along the axis of the well into the blowout preventer in order to counteract the pressure of the upwardly flowing material from the well. Typically, several blowout preventers are arranged in the blowout preventer stack, whereby blowout preventers arranged closer to the deposit are usually provided to envelope and seal the drill rods, and blowout preventers arranged further away from the deposit are provided for separating the drill string and hermetically sealing the well. Annular blowout preventers can be closed to a variable degree of tightness and are provided to achieve hermetical sealing of the well or around a drill rod. Blowout preventers and further blowout preventer stack components are typically operated and driven by means of hydraulic equipments. For that purpose, a hydraulic fluid is forced under pressure to the blowout preventers, which can actuate the blowout preventers by displacing or compressing the rams and/or annular elastic elements in per se known manner, for example opening or closing them.

A typical blowout preventer stack has on its end facing towards the well a wellhead connector, which serves for hermetically enclosing the topmost pipe casing (standpipe casing), a short portion of which protrudes from the concrete floor of the wellhead, and thereby connecting the blowout preventer stack to the well. For that purpose, the wellhead connector has typically a larger diameter than the standpipe casing and is provided with collet segments arranged at an inner circumference. If the wellhead connector is positioned on the standpipe casing, the collet segments can be forced under pressure against a stack connector, which is positioned at the end of the standpipe casing, in order to provide hermetic sealing. In the case of a blowout preventer stack breakdown or if the blowout preventer stack is to be replaced as a matter of routine, the wellhead connector must be opened so that the blowout preventer stack can be removed from the well and be replaced by a new blowout preventer stack or, in the case of extraction, by a Christmas tree.

Atop the wellhead connector follow one or a plurality of pipe ram blowout preventers for sealing respectively different pipe diameters. The pipe ram blowout preventers have two oppositely arranged rams with recesses which are commensurate with the diameter of a drill rod. If a pipe ram blowout preventer is activated, the oppositely arranged rams are moved towards one another until they sealingly enclose a drill rod with a diameter which is commensurate with the recess. Depending on the drilling depth, a different number of pipe ram blowout preventers are arranged in a stacked manner.

Atop the pipe ram blowout preventers follows a shear ram blowout preventer, which is provided to cut through a drill rod of the drill string. For that purpose, the rams of the shear ram blowout preventers have shearing edges, which can cut through drilling rods in the manner of scissors. Preferably, the shear ram blowout preventer also serves for cutting through the drilling rod and simultaneously sealing the drill rod hole. Usually, however, sealing of the shear ram blowout preventer does not suffice, so that often an annual blowout preventer is additionally arranged on top of it. This serves for hermetically sealing the drill rod hole and/or the entire well.

There follows a further annular blowout preventer, which serves to seal the blowout preventer stack. The upper annular blowout preventer is connected to a Lower Marine Riser Package—LMRP.

In a special case of a blowout preventer on the sea bottom, the annual blowout preventer is followed by a riser connector. This is intended for sealingly connecting a riser. The riser typically comprises pressure-tight steel pipes, into the interior of which the drill string and jetting liquid are directed. The inner diameter of the riser is larger than the diameter of the drill string and is typically ca. 533 mm (21 in).

The Lower Marine Riser Package (LMRP) constitutes yet another division plane of the blowout preventer stack if the riser has to be separated from the blowout preventer stack. This can for instance be the case if the drilling vessel must leave its position, e.g. due to an iceberg drifting towards the drilling vessel. In such case, the well can be sealed by means of the blowout preventer stack. The drilling vessel can, after the Lower Marine Riser Package (LMRP) has been separated, leave its position and, at a later point in time, reconnect the riser to the blowout preventer stack.

The blowout preventer stack may not fail, because not sealing the well on the occasion of a blowout is associated with considerable economical and ecological costs. Therefore, there exist high security requirements on blowout preventer stacks, particularly for drillings on the sea bottom. The use of several redundant supply and safety systems is thus indispensable. Therefore, blowout preventer stacks comprise, besides the blowout preventers, kill lines and choke lines connected to separate lines, which are adapted to inject filling material under high pressure into the well and/or the blowout preventer stack or to reduce the pressure in the blowout preventer stack by discharging material in order to still permit successful sealing of the well in the case of complete or partial breakdown of the blowout preventer.

U.S. Pat. No. 3,667,721 discloses a blowout preventer comprising a sealing element having an elastic sealing means. A plurality of metallic displacement means can be slidably moved against a curved inner surface of the housing in order to bring the sealing element into a sealing position, wherein the sealing means is arranged against an actuating piston. The sealing means can be circumferentially in contact with the curved inner surface of the housing to form a seal. The sealing element can respond to changes of the diameter of components of a drilling string by adjustment of the sealing element.

US 2008/0023917 A1 discloses a seal and a method of manufacturing a seal for a blowout preventer. The seal includes a rigid material insert disposed within an elastomeric body, wherein at least one portion is selectively de-bonded from the elastomeric body. On the rigid material insert which is de-bonded from the elastomeric body, a release agent, like silicone, can be applied. The method comprises generating a finite element analysis seal model, wherein a strain plot is analyzed based on displacement conditions, and wherein subsequently in the finite element analysis at least one portion of the rigid material insert is identified, which is selectively de-bonded from an elastomeric body. The method further comprises the manufacture of the seal with the rigid material insert, that is selectively de-bonded from the elastomeric body.

U.S. Pat. No. 6,719,042 B2 discloses the arrangement of shear rams for shearing an oil riser. The arrangement comprises two slidable rams, which are respectively slidable along different ram axes, one of which has an upper blade and the other has a lower blade. The surfaces of the blades of the rams are closely adjacent as the blades for shearing the oil riser are moved towards one another. A sealing system is positioned within a recess in the upper surface of the lower blade. The sealing system comprises an elastomeric seal and an actuator for sealing the lower planar surface of the upper blade. The actuator is movable relative to the lower blade to put the elastomeric seal under tension.

U.S. Pat. No. 5,655,745 discloses a lightweight hydraulic blowout preventer, comprising a blowout preventer body, hinge plates and two pairs of rams. The blowout preventer body has openings for guiding a drill rod and, perpendicularly thereto, two mutually superposed oppositely arranged guideways each for a respective pair of rams. Two bonnets are respectively secured to the blowout preventer body by means of a small number of connecting bolts, which are, viewed from the ram axis, arranged perpendicularly to one another along a continuous radius or along a single line. The bonnets form guideway extensions, in each of which a ram is operating, respectively. A hydraulic piston of a respective ram is surrounded by a metallic sealing, respectively. The bonnets are arranged on hinge plates. The connecting bolts of the bonnets can be unbolted and permit said bonnets to be pivoted apart from the body by means of the hinge plates.

U.S. Pat. No. 7,300,033 B1 discloses a blowout preventer operator closure system comprising a closure member, a piston rod, an operator housing, a piston, a sleeve and a closure rod. The piston rod is coupled with one end to the closure rod. The operator housing is with coupled one end to a bonnet and with a second end to a head. The piston rod extends through the bonnet into the operator housing and is therein connected to the piston having a body and a flange. The sleeve is helically fixed within a cavity of the piston and, by means of the locking rod, which is rotationally fixed to the head, can be displaced axially relative to the piston. One end of the closure rod extends through the head and can be operated under water outside of the operator housing.

WO 02/36933 A1 discloses a blowout preventer including a shut-off device and a connecting channel. The shut-off device can be transversely displaced with respect to the connecting channel by means of a drive device. The shut-off device comprises two individually or synchronously operable electric motors and a self-locking gear unit. The self-locking gear unit is drivingly connected to the electric motors.

SUMMARY OF THE INVENTION

It is the object of the invention to provide an improved blowout preventer stack, particularly for depth drillings on the seabed.

According to the invention, this object is achieved by a blowout preventer stack comprising blowout preventer stack components, at least one of which includes a blowout preventer and an electrical blowout preventer drive means for operating the blowout preventer. For that purpose, the energy for operating the blowout preventer is provided by a kinetic energy storage device.

Preferably, the kinetic energy storage device is a centrifugal mass storage device. A plurality of kinetic energy storage devices can be centrifugal mass storage devices. The centrifugal mass can be a flywheel, an oscillating rod, an oscillating cylinder or the like, and is preferably a flywheel. The kinetic energy storage device can be designed as a motor-generator combination and receive, convert, store and again supply energy. In particular, the kinetic energy storage device can be adapted for energy recuperation. Preferably, the kinetic energy storage device converts stored kinetic energy into electric energy and/or electric energy into kinetic energy. In a preferred embodiment, the kinetic energy storage device, for instance the centrifugal mass storage device, comprises one or a plurality of different magnetic materials.

A kinetic energy storage device, by way of example in the form of a centrifugal mass storage device, has rotational speeds of preferably 10,000-12,000 rpm and can reach up to 100,000 rpm. Preferably, the kinetic energy storage devices of the blowout preventer stack run constantly under maximum rotational speed in order to permanently serve for the energy supply of the blowout preventer drive means or for operation of the blowout preventers. The rotational speed can be measured by a control unit, which is connected to the kinetic energy storage device. Thereby, the level of the rotational speed makes it possible to determine the energy supply of the kinetic energy storage devices, like for instance the flywheel energy storage devices. In order to reduce or prevent high mechanical stress on rotary bearings of the kinetic energy storage devices, the rotary bearings are preferably magnetic rotary bearings. An eddy current brake for braking the kinetic energy storage devices is conceivable.

The blowout preventer drive means can operate the blowout preventers directly by means of kinetic energy from the kinetic energy storage devices or by means of electrical drives, like electrical motors, which are preferably supplied with electric energy from the kinetic energy storage devices.

Preferably, the blowout preventer drive means comprise reduction gears, particularly spindle drives (harmonic drive gears), kinetic energy storage devices and/or electrical drives. A spindle drive or drives/a harmonic drive gear may be connected to a roller spindle by means of gear wheels. The roller spindle drive can be connected to the rams of the ram blowout preventers or annular elastic members of the annular blowout preventers and can be provided for closing and opening the rams or annular elastic members. Spindle drives have much lower rotational speeds than kinetic energy storage devices and must be coupled to the kinetic energy storage devices and/or blowout preventer drive means like electric motors by means of couplings and gear arrangements. Thus, centrifugal masses of centrifugal mass storage devices, as an exemplary embodiment of the kinetic energy storage devices, can permanently rotate and can constantly be kept at high revolution rates, because they can be decoupled from the spindle drives. Preferably, a respective kinetic energy storage device is connected by means of an electromechanical positively locking or positively locking coupling to a respective spindle drive (harmonic drive gear). Preferably, the spindle drives have steel rotors and can be carbon fiber reinforced. The spindle drives can also be connected to the blowout preventer drive means, like for example an electric motor, by means of a coupling and/or a gearing mechanism. A respective spindle drive is preferably self-locking gear wheels which in a stationary condition cannot be reversed without blowout preventer drive means, like for example an electrical drive, or is connected in a self-locking manner to respective gear wheels. A self-locking action can be realized for example by means of an epicyclic gear set, planetary gear set, or the like. Preferably, self-locking is permitted by a worm gearing comprising at least one worm associated with the blowout preventer drive means and a worm wheel associated with one of the rams. The worm wheel can be mechanically connected to a spindle of the spindle drive. The self-locking connection of the spindle drives to the gear wheels can be realized in both directions of rotation.

In a preferred embodiment, two self-locking gear wheels are arranged around the gear wheel of the roller spindle drive, which are provided for a forward drive and a reverse drive of the roller spindle drive, respectively. A respective one of the blowout preventer drive means connected to the self-locking gear wheel is connected to an energy supply and control system, for instance to an energy supply and control system Blue or Yellow. In this text, the systems designated with the colors Blue and Yellow designate two energy supply and control systems operable independently from one another. The use of the designation Blue and Yellow is customary in the industry.

In an alternative embodiment, four self-locking gear wheels are arranged crosswise around the gear wheel of the roller spindle drive, wherein two of them are respectively provided for a forward drive of the roller spindle drive an two of them are provided for a reverse drive of the roller spindle drive. A respectively self-locking gear wheel provided for the forward drive and one provided for the reverse drive are connected to a respective energy supply and control system, for example a Blue or Yellow system. For this embodiment, the self-locking gear wheels are preferably movable towards and away from a gear wheel of the roller spindle drive, so that the self-locking gear wheels can be in contact or not in contact with the gear wheel of the roller spindle drive.

In a preferred embodiment, the blowout preventer drive means is an electric drive, for example an electric motor or the like. The blowout preventer drive means can however also be a kinetic energy storage device or comprise a kinetic energy storage device. Preferably, each blowout preventer is connected to two or more blowout preventer drive means which can operate the blowout preventer independently of one another. Components of the blowout preventer drive means or the complete blowout preventer drive means can be replaceable. In particular, replacement of a blowout preventer drive means can be performed while another blowout preventer drive means is in operation, so that no interruption in operation of the blowout preventer stack is necessary for the replacement of a blowout preventer drive means. Under water replacement of a blowout preventer drive means is also possible.

Preferably, the blowout preventer stack components of the blowout preventer stack are operable all-electric. The complete blowout preventer stack can also be operable all-electric.

The invention involves the realization that the all-electric systems claimed by the invention, in contrast to hydraulic or hybrid electrical-hydraulic system mainly known from the prior art and used in common practice are simpler, offer increased safety and also facilitate improved information exchange. The increased safety is a consequence of the greater redundancy of the all-electric safety systems, because a plurality of blowout preventer drive means can be operated independently from one another. In particular the redundancy for operating the blowout preventer stack is, in comparison to the prior art, enhanced by the possibility of emergency energy supply systems and emergency control systems. Moreover, the electric parts of a component are more easily exchangeable, so that only parts of a blowout preventer stack component have to be exchanged, which results to a lower maintenance effort. Improved information exchange is rendered possible, since electric systems can transmit data from and to sensors; for example, the proper operability of the blowout preventer can be tested at any time.

In a preferred embodiment of the blowout preventer stack, the blowout preventer stack is connected to two or more independent energy supply and control systems, for example energy supply and control system Blue and energy supply and control system Yellow. The two or more energy supply and control systems are preferably operable independently from one another. The energy supply and control systems are provided to supply the blowout preventer stack components of the blowout preventer stack with energy. Moreover, the energy supply and control systems can transmit data signals for measuring parameters and/or controlling the blowout preventer stack components to the blowout preventer stack components and receive them from the blowout preventer stack components. The energy supply and control systems are preferably all-electric and provided in double, which permits parallel operation of the energy supply and control systems and also a switching between different drives.

In a further preferred embodiment, the blowout preventer stack is connected via one or several emergency cables to one or a plurality of emergency supply and emergency control systems. The emergency supply and emergency control systems preferably fulfill the same functions as the energy supply and control systems, i.e. the emergency supply and emergency control systems provide the blowout preventer stack components of the blowout preventer stack via the emergency cable with energy and/or transmit and receive data signals for measuring parameters and for controlling the blowout preventer stack components to/from the blowout preventer stack components. The emergency cables can for example be connected to a buoy, a vessel, a land station, a remotely operated vehicle (Remotely Operated Underwater Vehicle—ROV), an underwater steam turbine arrangement or the like, which either can provide energy, send data signals, receive data signals or provide a combination of those functions. In parallel, also a plurality of emergency supply and emergency control systems can be connected to the blowout preventer stack and receive data from said blowout preventer stack. Preferably, the blowout preventer stack is configured such that the emergency supply and emergency control systems respectively have a different priority, so that control is mainly effected by means of one system while the other systems serve as additional redundant emergency systems. In particular, the emergency supply and emergency control systems are provided to release in case of emergency both the wellhead connecting device (wellhead connector) and the lower marine riser package (LMRP). In that way, a new blowout preventer stack can be brought onto the wellhead and the riser can be separated from the blowout preventer stack. In particular, the wellhead connecting device (wellhead connector) includes additional electrical connectors which can be switched off for safeguarding the redundant systems, if dead or short-circuited electric circuits are connected to them.

Parallel operation of the energy supply and control systems is a further aspect of the invention, which can also be realized independently of the other aspects described herein. Parallel operation of the energy supply and control systems offers, in comparison with hydraulic systems which can be operated only by one respective system and which also do not allow testing of the functionality of a second hydraulic systems (redundancy system) until the first hydraulic system is switched off, the advantage of a redundancy and the possibility of functionality control of the systems used. Furthermore, this allows the connection of an unlimited number of further emergency supply and emergency control systems to the blowout preventer stack and to its components, which provides further redundancy and thus safety.

Preferably, energy supply and control systems are connected via a monopolar line, like for example a monopolar coaxial cable, in which the shielding is conductive as ground, to the blowout preventer stack or to the blowout preventer stack components. The lines can be guided in steel pipes in order to protect them from external influences, like for example falling objects, marine organisms or other environmental influences. One connector is arranged at a respective end of a monopolar power supply line. The connectors, which end at the blowout preventer stack, are preferably sealed with seals such that no sea water can penetrate into said connectors. The connectors can comprise pressure generating means or can be connected to pressure generating means, which create an overpressure within the connectors which is higher than the ambient pressure in order to prevent a penetration of sea water. In a preferred embodiment, the monopolar lines are respectively connected to a connector of the blowout preventer stack and to a connector of an energy supply and control system. Preferably, only one line is provided between an energy supply and control system and the blowout preventer stack. In a preferred embodiment, each connector comprises one or several sensors, which are provided to assess the functionality of the connector and to provide a data signal, which can be transmitted via the monopolar line to the energy supply and control system. The data communication via the monopolar line between the blowout preventer stack components, sensors, sensors of the connectors and other devices situated on the sea bottom, which are adapted for the data communication, and the energy supply and control systems and other devices adapted for data communication, is preferably achieved by HF modulation of the supply voltage via the one contact of the monopolar line. Preferably, the supply voltage has a voltage of 400 to 600 V. The HF modulation of the supply voltage has a lower voltage than the supply voltage and a higher frequency, for example 15 V.

In a further preferred embodiment of the blowout preventer stack, the blowout preventer stack is connected to one or more steam turbine arrangements. The connection in that case is such that the steam turbine arrangement can provide the blowout preventer stack components and/or the blowout preventer stack with electric power, which is stored in one or a plurality of steam accumulators of the steam turbine arrangement in the form of hot pressurized steam. The steam turbine arrangement is provided to operate one or a plurality of blowout preventers of the blowout preventer stack, for example for electrically closing or opening it. For providing the electric energy, the one or the plurality of steam accumulators of the steam turbine arrangement are preferably permanently filled with hot highly pressurized steam or are being permanently filled with hot highly pressurized steam, which can at any time be converted into electric energy by means of a steam turbine and a generator. Preferably, the energy stored in a steam accumulator of the steam turbine arrangement suffices to close, open, and again close a blowout preventer. Preferably, the steam accumulator is provided with a heating element, which can be operated by the energy of an energy source positioned externally of the steam turbine arrangement, and which can for example heat water in the steam accumulator for generating hot steam. Preferably, electric energy is generated on a drill ship on the surface of the sea, for example by means of a diesel generator, and transferred by an electric line in form of electricity to the steam turbine arrangement, which can use it in a heating element for heating and vaporization of water. The energy stored in the steam can be converted into electric energy at any time, e.g. by means of a steam turbine and a generator. It is also possible to fill a respective steam accumulator with hot steam from a steam source positioned externally of the steam turbine arrangement. A temperature measuring device, for instance a thermometer, thermo element or the like arranged in the steam accumulator, can measure the temperature of the steam, by means of which the energy stored in the steam accumulator can be determined. The steam accumulator can be a pressure vessel, for example a cylindrical pressure vessel of a diameter of 0.5 m to 1 m and a height of 2.5 m to 4 m. The steam turbine arrangement is preferably provided as an emergency supply system and can be connected via a monopolar line to the blowout preventer stack or to one or a plurality of blowout preventer stack components. Preferably, one of the steam turbine arrangements is connected to the blowout preventer stack component which comprises the shear ram blowout preventer. Lines between the steam turbine arrangement and further energy supply and control systems are also conceivable, for example for the energy supply to the steam accumulator and/or for controlling the steam turbine arrangement.

A steam turbine arrangement for the energy supply to a blowout preventer stack on the sea bottom also represents an idea that can be realized independently of the embodiment of the blowout preventer stack, i.e. the steam turbine arrangement is also adapted for the supply of electrical components of a conventional blowout preventer stack. Application to fully hydraulically operable blowout preventer stacks is also conceivable, insofar as additional pressure generating devices are installed on the sea bottom, which can be operated by means of the energy of one or a plurality of steam turbine arrangements, wherein the pressure generating devices are adapted to generate pressure for hydraulic fluid in order that said hydraulic fluid can operate a hydraulically operable blowout preventer stack. It is also conceivable to use the steam pressure itself for operating a blowout preventer component.

It is an advantage of the invention that any electric current, in particular also electric current generated on the surface of the sea by means of a diesel generator, can be fed into the steam turbine arrangement, which then converts it into thermal energy in the form of steam, i.e. high demands are not made on the quality of the current, e.g. frequency, voltage stability or similar properties. The steam can be used in the steam turbine arrangement for generating electric energy, which can be used for operating the blowout preventer stack. Since the steam turbine arrangement and the steam accumulator included therein are arranged on the sea bottom, the risk of breakdown caused by a damaged line between energy source and blowout preventer stack is significantly reduced.

In a preferred embodiment, a plurality of kinetic energy storage devices are arranged and interconnected in a blowout preventer stack component or in a blowout preventer drive means. For instance, adjacent kinetic energy storage devices or all kinetic energy storage devices can be interconnected. Preferably, the kinetic energy storage devices can transfer energy, in kinetic or electric form, to another energy storage device or receive it from another kinetic energy storage device. The kinetic energy storage devices also can transfer stored energy to another blowout preventer drive means or kinetic energy storage device of another blowout preventer stack component and/or receive it from another blowout preventer stack drive means or kinetic energy storage device of another blowout preventer component. In that way, all interconnected kinetic energy storage devices can serve as an energy reservoir for operation of the blowout preventers, blowout preventer drive means and/or blowout preventer stack components of the blowout preventer stack. This increases safety, since redundant energy storage devices are available on-site, from which, in the case of disturbance of one of the kinetic energy storage devices or partial or entire damage of the connection to the energy supply and control systems, it is still possible to receive energy by means of other kinetic energy storage devices in order to operate a part of or the complete blowout preventer stack.

In a further preferred embodiment, a blowout preventer, a blowout preventer stack component or a blowout preventer drive means comprises one or a plurality of force sensors and/or position sensors. The force sensors are preferably adapted to measure a force acting on the rams of the ram blowout preventers or on the annular elastic elements of the annular blowout preventers and to provide a data signal comprising the measurement data (force data), which can be transmitted via a line, for example the monopolar line, to the energy supply and control systems. The position sensors are preferably adapted to measure the position of the rams of the ram blowout preventers or of the annular elastic elements of the annular blowout preventers and to provide a data signal comprising the measuring data (position data), which can be transmitted via the monopolar line to the energy supply and control systems. By means of the measuring data, the control system can precisely control the blowout preventers and adjust them such that the least amount of wear with an optimum sealing effect can be achieved.

A further aspect of the invention is therefore the improved and/or more precise control of the blowout preventers of the blowout preventer stack, which is particularly advantageous for the so-called "snubbing" and "stripping", respectively. In this text, "snubbing" is understood as the extraction of drill rods of a drill string from the well, while pressure from the bottom is present in the well, wherein the blowout preventer seals off the shaft around the drill rod diameter. Preferably, pipe ram blowout preventers are used for "snubbing". In particular, the use of all-electric blowout preventers or blowout preventers having force and/or position sensors for "snubbing" is also advantageous for blowout preventer stacks for deep onshore drillings.

To use position and/or force sensors for collecting measurement data during "snubbing" by means of blowout preventers of a blowout preventer stack is also an idea that can be realized independently of the design configuration of the blowout preventer stack, i.e. it can also be applied to conventional blowout preventer stacks having at least electric lines.

The blowout preventer stack components of the blowout preventer stack or the blowout preventer stacks can be connected to the energy supply and control system by two or more overcurrent protection devices. The overcurrent protection devices and connectors can be embedded in solid pipes or rods which serve for preventing mechanical damage. Preferably, a first overcurrent protection device is arranged between a line portion at the supply system side and a connector to a blowout preventer stack component or to the blowout preventer stack. A second overcurrent protection device is preferably arranged between the connector and the one blowout preventer stack component or an internal line of the blowout preventer stack. The overcurrent protection devices are preferably adapted to interrupt the power line in the event of an excessively high current strength for a predefined time interval and thereby protect the circuits. The overcurrent protection device can be, for example, a fuse, a line safety switch, a combination thereof or the like, which interrupts the line temporarily or permanently. The first and second overcurrent protection devices can have different safeguard levels. The first overcurrent protection device protects the monopolar line preferably by interrupting the line as from an amperage of e.g. 100 A. The second overcurrent protection device protects the blowout preventer stack component, particularly the blowout preventer drive means, like for example the electric drive, as from an amperage of e.g. 50 A. Preferably, the first overcurrent protection device interrupts the circuit as from an amperage higher than the second overcurrent protection device.

In a further preferred embodiment, the energy supply and control systems and the blowout preventer stack components or the blowout preventer stack are connected via lines which include semiconductor switches. The semiconductor switches can open or close a circuit between energy supply and control systems and blowout preventer stack components or blowout preventer stack. Mechanical switches are also possible, however, they have a shorter service life and are less reliable than semiconductor switches.

In a preferred embodiment, an electric blowout preventer drive means comprises two or more kinetic energy storage devices. Preferably, the kinetic energy storage devices for operating a blowout preventer are adapted for operating a blowout preventer or are adapted for providing the energy for operating a blowout preventer. The kinetic energy storage devices can be series connected such that they can exchange energy with one another. Particularly preferably one of the kinetic energy storage devices (forward energy storage device) rotates in a first direction and another energy storage device (reverse energy storage device) rotates in a direction reverse to the first direction. The kinetic energy storage devices rotating in the first direction (forward energy storage devices) are preferably adapted and arranged to generate a forward drive of the rams of the ram blowout-preventers or of the elastic elements of the annular blowout preventers, which leads to a closure of the blowout preventer. The kinetic energy storage devices rotating in a direction opposite to the first direction (reverse energy storage devices) are preferably adapted and arranged to generate a reverse drive of the rams of the ram blowout preventers or of the elastic elements of the annular blowout preventers, which leads to an opening of the blowout preventer. A plurality of kinetic energy storage devices can also rotate in the first direction or in the direction opposite to the first direction. Preferably, more kinetic energy storage devices rotate in the first direction, since a forward drive by means of the forward energy storage devices and thus closure of the blowout preventer and severing of a drill rod generally requires more energy than opening of a blowout preventer, which is made possible by a reverse drive by means of the reverse energy storage devices. The kinetic energy sources can also be adapted such that their direction of rotation during energy input can be adjusted, whereby each kinetic energy storage device can serve both as a forward energy storage device and as a reverse energy storage device.

In a preferred embodiment of the blowout preventer stack, the blowout preventer stack includes as blowout preventer stack components an upper annular blowout preventer (upper annular BOP), a riser connector, a lower annular blowout preventer (lower annular BOP), a shear ram blowout preventer (shear ram BOP), a predefined number of pipe ram blowout preventers (pipe ram BOPs) matched to the well depth, and a wellhead connector device (wellhead connector). The blowout preventer stack can also include a plurality of said blowout preventer components. The embodiment is particularly preferred for drillings on the sea bottom, wherein the blowout preventer stack is arranged on top of the well on the sea bottom and connected by means of a riser connector to a drill ship or a drilling platform, which is positioned on the surface of the sea or the water. In a further embodiment, for example for use on land, the blowout preventer stack can have only an annular blowout preventer and can be without a riser connector device (riser connector). Preferably, all blowout preventer stack components are electrical and/or electrically operable. The blowout preventer stack components can also be at least partially kinetically operable, i.e. with kinetic energy from the kinetic energy storage devices.

BRIEF DESCRIPTION OF THE DRAWINGS

In the following, the invention is described in greater detail by means of the schematically illustrated exemplary embodiments. In the Figures.

DETAILED DESCRIPTION

Figure 1:
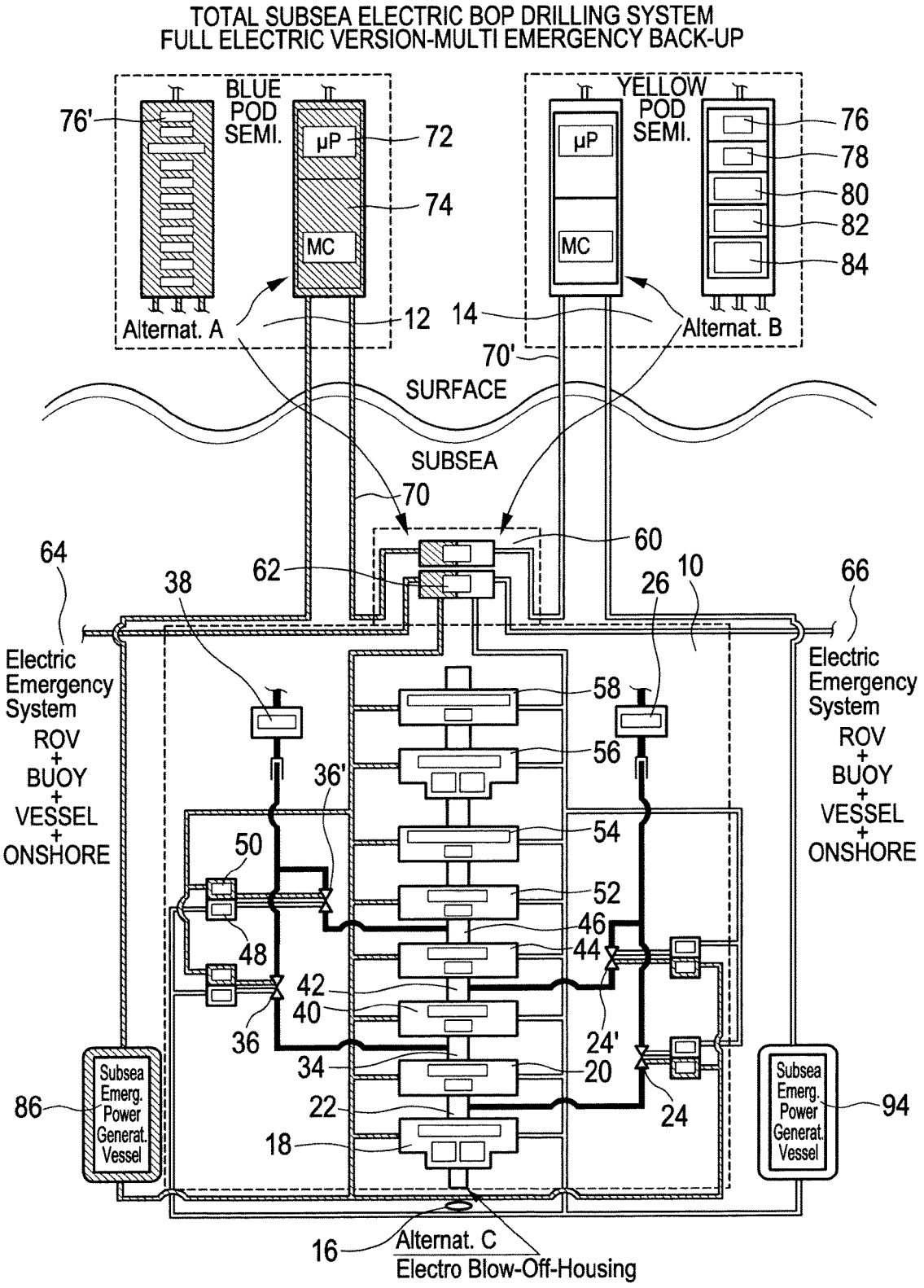
FIG. 1 is a schematic illustration of a blowout preventer stack located at the sea bottom with connected energy supply and control systems.

FIG. 1 shows an all-electric blowout preventer stack 10 positioned at the sea bottom with connected energy supply and control systems Blue 12 and Yellow 14. The blowout preventer stack 10 is specifically designed for operation during a drilling process. The structure of the blowout preventer stack 10, beginning from a wellhead 16 located at the sea bottom, in a direction towards the energy supply and control systems Blue 12 and Yellow 14 located at the sea surface, is described hereinafter.

The blowout preventer stack 10 is connected to a standpipe casing (not shown), which protrudes from the wellhead 16, by a wellhead connector 18 arranged on top of the wellhead 16. The wellhead connector 18 has collet segments (not shown), with which the wellhead connector 18 encloses the standpipe casing under pressure and provides a sealing closure. The wellhead connector 18 is connected on the left side to a line of the energy supply and control system Blue 12 and on the right side to a line of the energy supply and control system Yellow 14. All of the following blowout preventer stack components are also connected to the two energy supply and control systems Blue 12 and Yellow via lines, which is not explicitly mentioned hereinafter. The connection to both energy supply and control systems Blue 12 and Yellow 14 allows redundant operation of the blowout preventer stack components; particularly if one of the energy supply and control systems Blue 12 or Yellow 14 or their line is damaged and fails, the blowout preventer stack components can be continue to be operated via the other energy supply and control system Yellow 14 or Blue 12.

A lower pipe ram blowout preventer 20 is arranged on top of the wellhead connector 18. The first interspace 22 between the wellhead connector 18 and the lower pipe ram blowout preventer 20 is connected to a choke line 26 by means of a choke valve 24. The choke line 26 can discharge suspension, like for example a mixture of rock material, slurry, water and oil, which flows during operation from below out of the wellhead, from the first interspace 22 in order to reduce the pressure on the main line section which is positioned in the blowout preventer stack 10 and in which drilling is undertaken.

Figure 3:
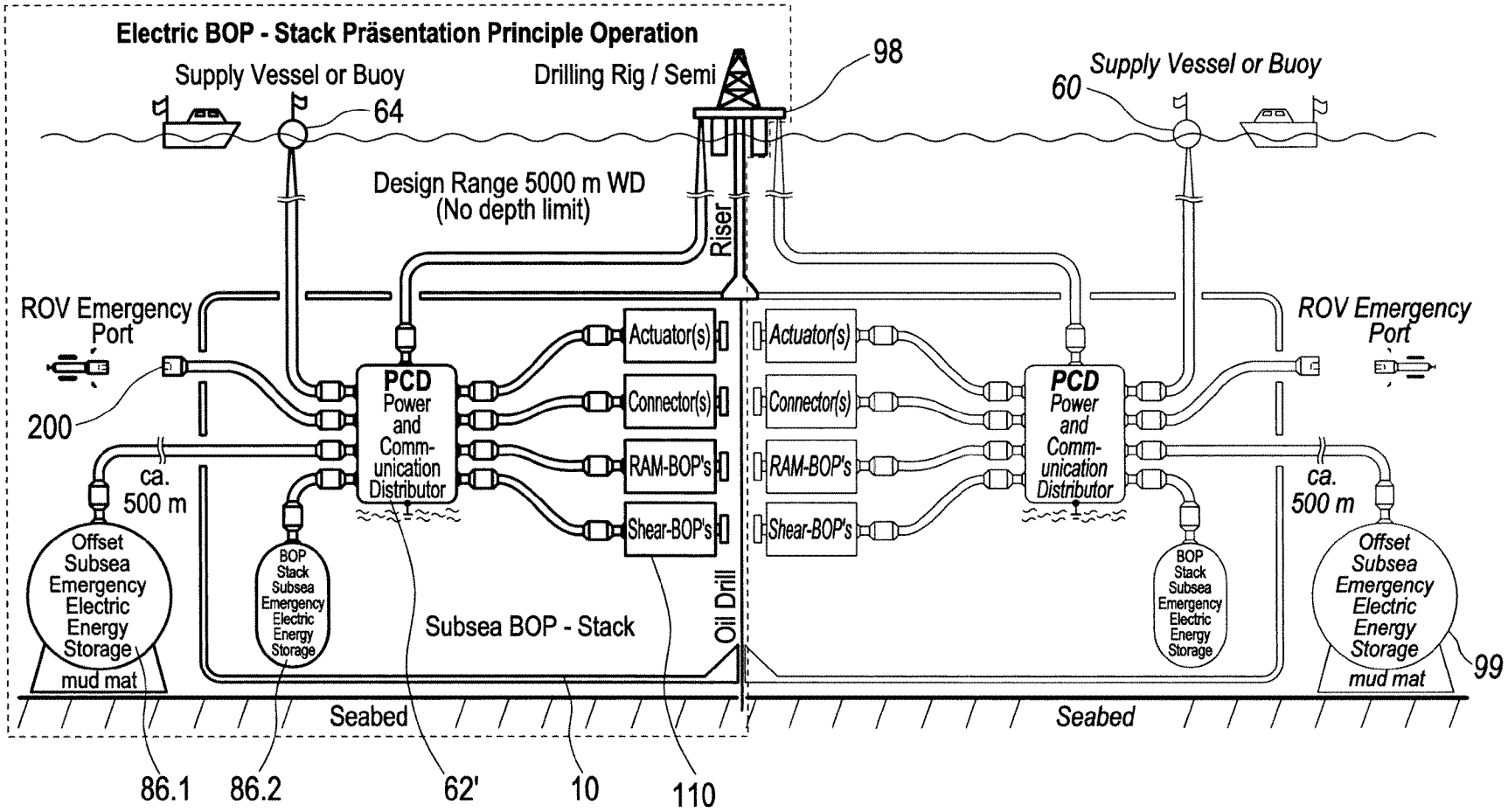
FIG. 3 is an alternative representation of a blowout preventer stack with connected energy supply and control systems.

The lower pipe ram blowout preventer 20 includes two oppositely arranged rams, slides or jaws 28 with a cut-out 30, which is matched to the largest diameter of the drill rods 32 used (see FIG. 3). In operation, the lower pipe ram blowout preventer 20 can be closed and sealingly enclose the drill rod 23, or can be opened in order to enable a connection of the first interspace 22 to a second interspace 34 of the blowout preventer stack 10. The second interspace 34 is, by means of a kill valve 36, connected to a kill line 38, which is adapted to force a suspension, for example of rock material, slurry, water, cement, dirt or the like, under pressure into the second interspace 34 and thereby generate backpressure against the material flowing during operation from below out of the well or to close the well.

Arranged on top of the second interspace 34, a middle pipe ram blowout preventer 40 which is adapted to seal a middle pipe diameter of the drill rods 32 used and which is—except for a smaller cut-out 30—identical to the lower pipe ram blowout preventer 20.

On top of the middle pipe ram blowout preventer 40 follows a third interspace 42, which is connected to the choke line 26 by means of a further choke valve 24'. Via the third interspace 42, suspension can also be discharged by means of the choke line 26 in order to reduce the pressure in the blowout preventer stack 10.

Arranged on top of the third interspace 42 is an upper pipe ram blowout preventer 44 which is adapted to seal a smallest pipe diameter of the drill rods 32 used and which is, except for a smaller cut-out 30, identical to the middle pipe ram blowout preventer 40. Depending on the maximum drill depth, a different number of pipe ram blowout preventers can be arranged in the blowout preventer stack 10. A greater depth requires more pipe ram blowout preventers, because a larger number of different drill rod diameters must be used for drilling the well.

Arranged on top of the upper pipe ram blowout preventer 44 is a fourth interspace 46 which is connected to the kill line 38 by means of a kill valve 36'. The kill valve 36', like also the other kill valve 36 and the choke valves 24 and 24', is operated by means of two respective valve control units Yellow 48 and Blue 50 operating independently of each other, i.e. the valve control units Yellow 48 and Blue 50 can adjust the open condition of the kill valve 36'. In this exemplary embodiment, the kill valves 36, 36' and the choke valves 24, 24' are gate valves, which are either fully opened or closed. It is also possible to use valves which can be partly opened or closed. The valve control unit Yellow 48 is connected to the energy supply and control system Yellow 14 and the valve control unit Blue 50 is connected to the energy supply and control system Blue 12. Thereby, the kill valves 36 and 36' and the choke valves 24 and 24' can be remotely operated by means of the energy supply and control systems Yellow 14 and Blue 12. The connection of the choke line 26 and the kill line 38 to the drill ship or the drilling platform allows for a further control of the lines 26 and 28, by for example their pressure being adjusted by means of pressure pumps (not shown).

A shear ram blowout preventer 52 is arranged on top of the fourth interspace 46. The shear ram blowout preventer 52 differs from the pipe ram blowout preventers 20, 40 and 44 in the design and shape of the rams 28. The oppositely arranged rams 28 of the shear ram blowout preventer 52 have a small offset in height in relation to one another and have shearing edges, which can cut through drill rods 32 like scissors. During closing of the shear ram blowout preventer 52, the rams 28 arranged oppositely and offset in height in relation to one another overlap along a ram axis, so that a drill rod 32 positioned between the rams 28 can be cut through.

When the shear ram blowout preventer 52 in operation has cut through a drill rod 32, a cut-through open end of the drill rod 32 protrudes into the fourth interspace 46. The connection between kill line 36 and the fourth interspace 46 arranged directly below the shear ram blowout preventer 52 is provided to seal the interior space of the drill rod 32 with suspension, while the more deeply positioned pipe ram blowout preventers 20, 40 and 44 are provided to seal the annular shaft around the drill rod 32. For that purpose, the choke line 24 can discharge suspension from the first interspace 22 and/or the third interspace 42 in order to reduce the pressure at these locations.

The shear ram blowout preventer 52 comprises at the top side of the more deeply positioned ram 28 a sea which can be forced against the bottom side of the higher positioned ram 28 to create a sealing closure. Usually, however, that seal does not suffice to form a sealing closure against material leaking from the well, for which reason a lower annular blowout preventer 54 is arranged on top of the shear ram blowout preventer 52.

The lower annular blowout preventer 54 serves for sealing closure of the drill rod hole and/or the entire well. For that purpose, the lower annular blowout preventer 54 comprises an annular elastic element with a plurality of ring elements reinforced by metal segments (not shown). The ring elements of the lower annular blowout preventer 52 are displaceable such that they can create a sealing closure by means of their contacting surfaces. In particular, the pressure of the ring segments of the elastic element against one another leads to deformation and compression of the elastic element, depending on the pressure. The elastic element can thus either enclose a drill rod 32 of any diameter and seal the part of the well around the drill rod 32 or also seal the entire well.

In this embodiment, the blowout preventer stack 10 is positioned at the sea bottom; therefore, a riser connector 56 is arranged on top of the lower annular blowout preventer 54. The riser connector 56 is adapted to sealing connect a riser. Pressure-tight steel pipes form the riser, in the inner space of which the drill string and jetting liquid can be passed. The inner diameter of the riser is in this embodiment approximately 533 mm (21 in), while the drill string and thus also the drill rods 32 have a maximum inner diameter of approximately 476 mm (18¾ in). The riser and the drill rods can also be of larger inner diameters, however, the free inner diameter of the riser is always larger that the outer diameter of the drill rods 32.

Arranged on top of the riser connector 56 is an upper annular blowout preventer 58 which is adapted to seal the blowout preventer stack 10.

The riser can be removed from the blowout preventer stack 10 so that the drill ship or the drilling platform can change its position, which can for example be necessary if an iceberg drifts towards the drill ship or the drilling platform.

Arranged on top of the upper annular blowout preventer 58 is a lower marine riser package—LMRP 60. The marine riser package (LMRP) 60 is adapted to seal the riser. After the blowout preventer stack 10 is sealed by the annular blowout preventers 54 and 58, the riser can be withdrawn from the blowout preventer stack 10 and the drill ship can change its position. At a later point in time, the drill ship can again take up a position at the surface of the sea over the blowout preventer stack 10 and the riser can be connected to the blowout preventer stack by means of the riser connector 56.

Besides the sealing function, the lower marine riser package (LMRP) 60 can also fulfill other functions, for example protection of the electric circuits, division plane between energy supply systems and control systems Blue 12, Yellow 14 and the blowout preventer stack 10, or other functions known to the man skilled in the art. In this embodiment, the marine riser package (LMRP) 60 includes an LMRP control unit 62, which is adapted to connect or disconnect the energy supply and control systems Blue 12 and Yellow 14 and other emergency energy supply and emergency control systems Blue 64 and Yellow 66 connected to the LMRP switching unit 62 to/from the blowout preventer stack 10 by means of switches. Emergency energy supply and emergency control systems can for example comprise remotely operated underwater vehicles, buoys, vessels and land stations. In this embodiment, the lines are connected to buoys 64 and 66 (see FIG. 2). The control unit 62' can also be arranged in the blowout preventer stack 10 (see FIG. 2). Control units 62 and 62' can also be arranged both in the lower marine riser package (LMRP) 60 and in the blowout preventer stack 10.

The energy supply and control systems Blue 12 and Yellow 14 are connected to the lower marine riser package (LMRP) 60 via a monopolar line 70 respectively. The line can also be multipolar. In particular, the energy supply and control systems Blue 12 and Yellow 14 can be operated independently of one another and also in parallel.

The energy supply and control system Blue 12 comprises a microprocessor unit 72 and a microcontroller unit 74, which is adapted to control the lower marine riser package (LMRP) 60 and the blowout preventer stack components, like the blowout preventers 20, 40, 44, 52, 54 and 58, the connectors 18 and 56 and the valve control units Blue 50, which control the valves 24, 24' and 36, 36' of the choke line 26 and of the kill line 38.

The energy supply and control system Yellow 14 can be identical to the energy supply and control system Blue 12 or comprise, for example, a Yellow energy source 76, a Yellow microprocessor unit 78, a first Yellow microcontroller unit 80, which controls a first part of the blowout preventer stack components, a second Yellow microcontroller unit 82, which controls a second part of the blowout preventer stack components, and a Yellow control unit 84, which, by means of switches, can provide connections between the individual blowout preventer components and the energy supply and control system Yellow 14.

The energy supply and control systems Blue 12 and Yellow 14 can also include an individual microcontroller for the control of each blowout preventer stack component.

The energy supply and control system Blue 12 is additionally connected by a further line to a subsea energy storage that is a steam turbine arrangement Blue 86. The steam turbine arrangement Blue 86 is provided with electric energy by the energy supply and control system Blue 12 and stores the electric energy in the form of steam in a steam accumulator 88 (see FIG. 6). The steam turbine arrangement Blue 86 is connected to the blowout preventer stack 10 by means of a line in order to supply the blowout preventer stack components with electric energy. The energy of the steam, which is stored in the steam accumulator 88, can at any time be converted into electric energy by means of a steam turbine 90 and a generator 92 included in the steam turbine arrangement 86. The electric energy makes it possible to operate the blowout preventer stack components even if the monopolar line 70 between blowout preventer stack 10 and the energy supply and control system Blue 12 is damaged and/or fails. The energy supply and control system Yellow 14 is also connected by a further line to the steam turbine arrangement Yellow 94, which is identical to the steam turbine arrangement Blue 86. The steam turbine arrangement Blue 86 and Yellow 94 serve as emergency energy supply systems.

Figure 2:
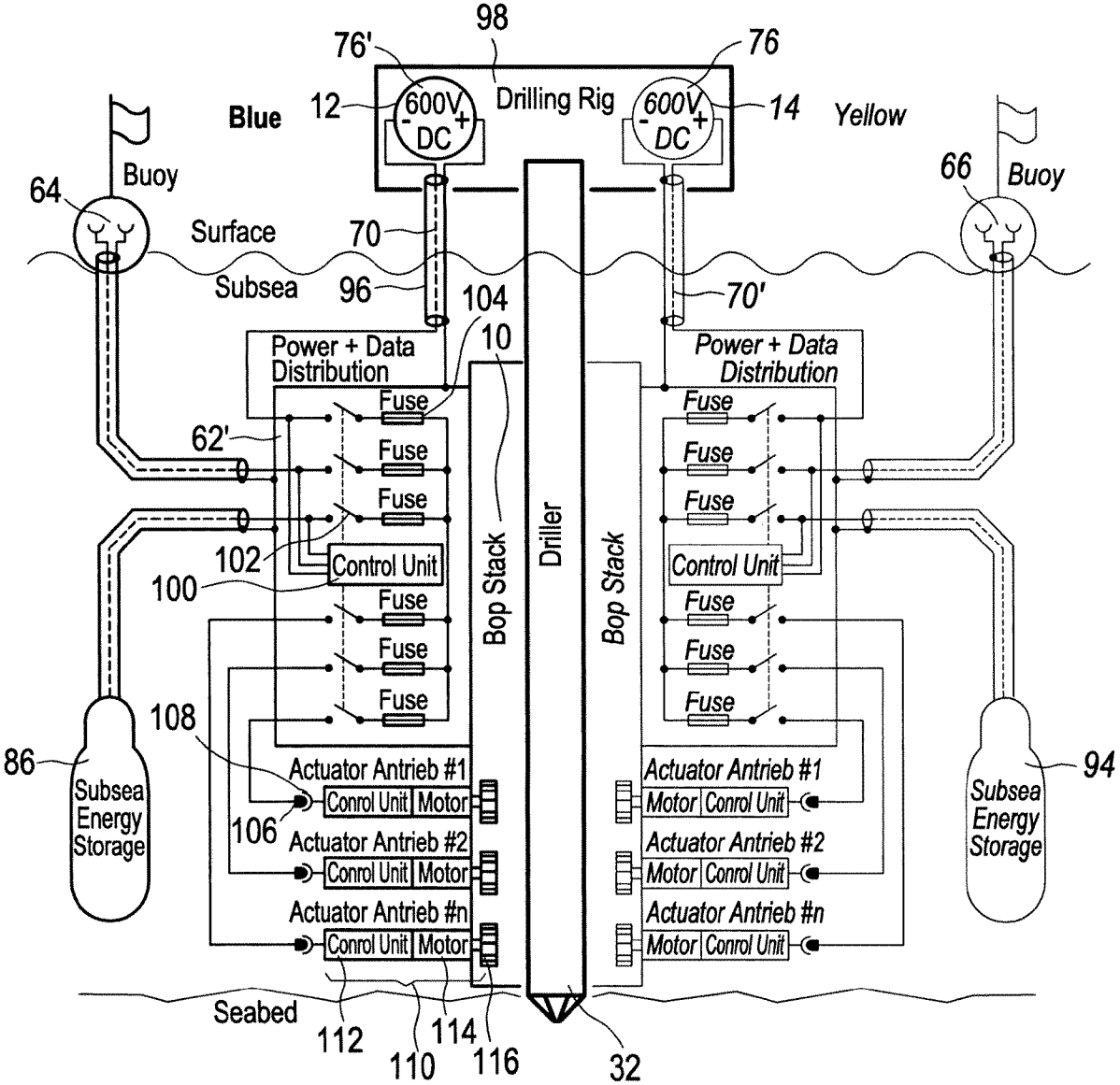
FIG. 2 is a schematic illustration of the electric circuit of the blowout preventer stack positioned at the sea bottom with connected energy supply and control systems.

FIG. 2 shows the circuit of the energy supply and control systems Blue 12 and Yellow 14 with the blowout preventer stack 10. Both circuits of the energy supply and control systems are identical and redundant in order to implement operation of the blowout preventer stacks even if one of the energy supply and control systems Blue 12 or Yellow 14 fails. The monopolar line 70 is connected to a Blue-energy source 76' and guided by means of a pressure-tight steel pipe 96 from the drilling platform 98 to the control unit 62'. The pressure-tight steel pipe 96 protects the monopolar line 70 and serves at the same time as a further line that makes it possible to close the circuit.

The control unit 62' includes a switch control unit 100, which is adapted to control switches 102, which can provide a connection between the energy supply and control systems and the blowout preventer stack components. The switch control unit 100 can close one or more switches 102, in order to connect one or a plurality of energy supply and control systems to one or more blowout preventer stack components. The switches 102 in this embodiment are semiconductor switches, mechanical switches are also possible, however not preferred because of their short service life. The lines leading via the closed switches 102 can transmit electric energy and data signals from one or a plurality of energy supply and control systems to the blowout preventer components individually selected by the switch control unit 100 and transmit data signals from the blowout preventer stack components to the one or plurality of energy supply and control system(s). The data signals can for example include control commands, measured values or the like. The data signals are achieved by HF modulation of the supply voltage by means of the one contact of the monopolar line 70. The supply voltage preferably has a voltage of 400 to 600 V. The HF modulation of the supply voltage has a lower voltage than the supply voltage and a higher frequency, for example 15 V.

In the illustrated embodiment, additionally to the energy supply and control system Blue 12, two more emergency systems are also shown, which are connected to the control unit 62'. A buoy 64 serves as an emergency energy supply and emergency control system and can, alternatively or additionally to the energy supply and control system Blue 12, be connected to the blowout preventer stack components. The steam turbine arrangement 86 serves in this embodiment as emergency energy supply system and can also alternatively or additionally be connected to the blowout preventer stack components. Use of the steam turbine arrangement 86 as an emergency control system is also possible by additionally transmitting data signals for controlling the blowout preventer stack components via the separate line, by which the steam turbine arrangement 86 is supplied with electric energy from the drilling platform 98.

Further emergency energy supply and emergency control systems are possible, for example emergency boats, land stations or subsea stations. The emergency energy supply and emergency control systems can be operated parallel to the energy supply and control systems Blue 12 and Yellow 14 or, alternatively, can be used in an emergency. Preferably, the emergency energy supply and emergency control systems have additional redundant lines to the blowout preventer stack 10. The lines can for example be connected to the wellhead connector 18 in order to be able to release it in an emergency.

Arranged behind the switches 102 of the control unit 62' are overcurrent protection devices 104 which are provided to interrupt the connection in the case of overcurrent in order to protect the blowout preventer stack components and/or the energy supply and control systems.

It is also possible for one or a plurality of further monopolar lines to be connected to the blowout preventer stack 10. Preferably, a monopolar line is connected to the wellhead connector device (wellhead connector), which is similar to the control unit 62' and can connect or disconnect electric circuits by means of switches in order for example to be able to disconnect dead or short-circuited lines.

The connection of an energy supply and control system to a blowout preventer stack component is effected by means of a monopolar connector 106, which is plugged into a connector contact 108 of the blowout preventer stack component. In the illustrated embodiment, the connector 106 is connected to a connector contact 108 of a blowout preventer drive means 110. The blowout preventer drive means 110 includes a motor control unit 112, a motor 114 and a self-locking gear wheel 116.

FIG. 3 is an alternative representation of a blowout preventer stack with connected energy supply and control systems. In addition to the components already depicted in FIG. 2, a remotely operated vehicle emergency port (ROV emergency port) 200 is shown which can be contacted by a remotely operated vehicle to thus provide for emergency energy supply. Operation of the energy supply and control systems shall be illustrated by a way of an example referring to FIG. 4 to 10.

Figure 4:
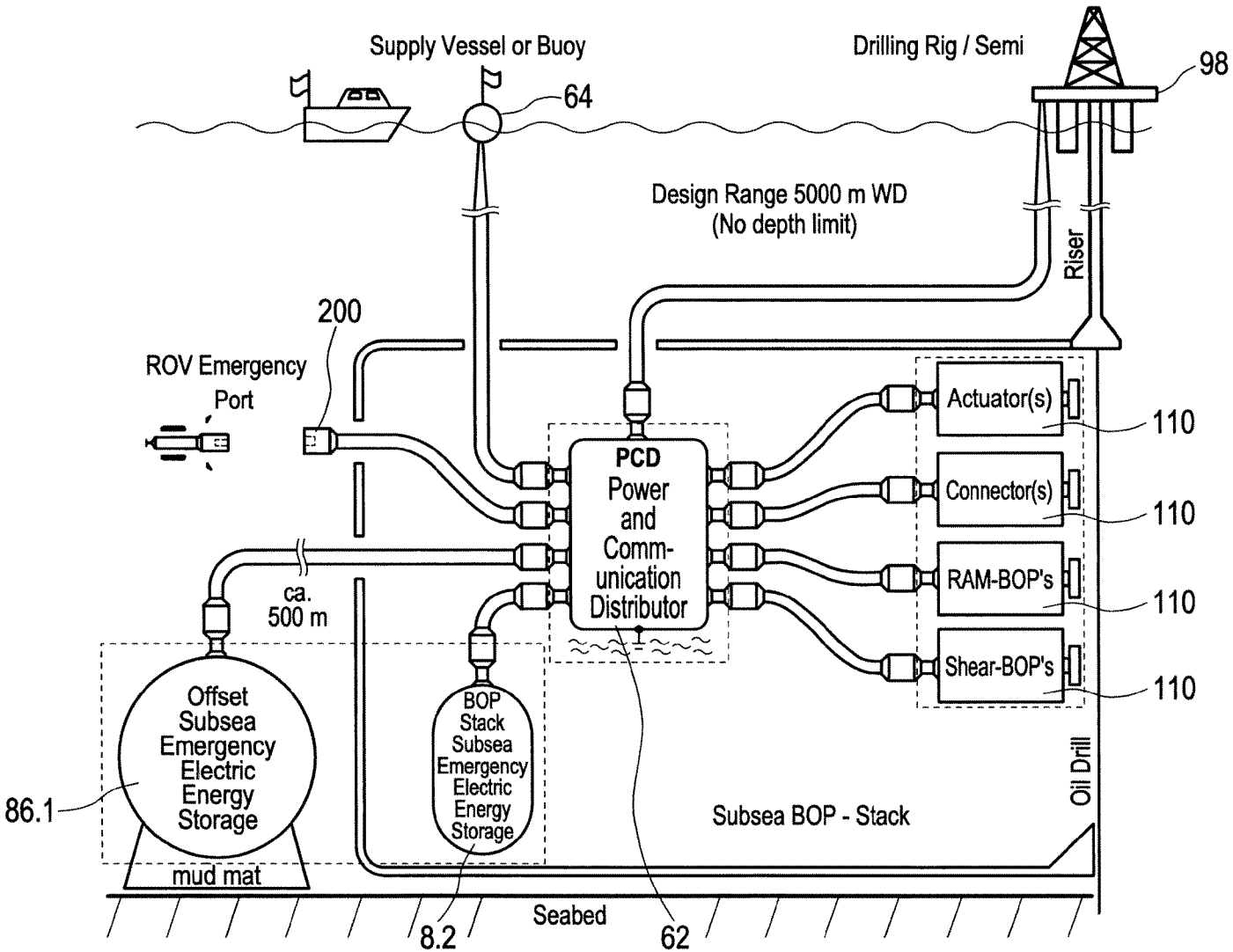
FIG. 4 is an enlarged view of the energy supply and control systems Blue on the left side of FIG. 3.

FIG. 4 is an enlarged view of the energy supply and control systems Blue on the left side of FIG. 3. FIGS. 4 to 10 illustrate how the blowout preventer drive means 110 of e.g. blowout preventers 20, 40, 44, 54 or 58 are supplied with energy in different situations. Energy supply is controlled by power and communication distributer (control unit) 62.

Figure 5:
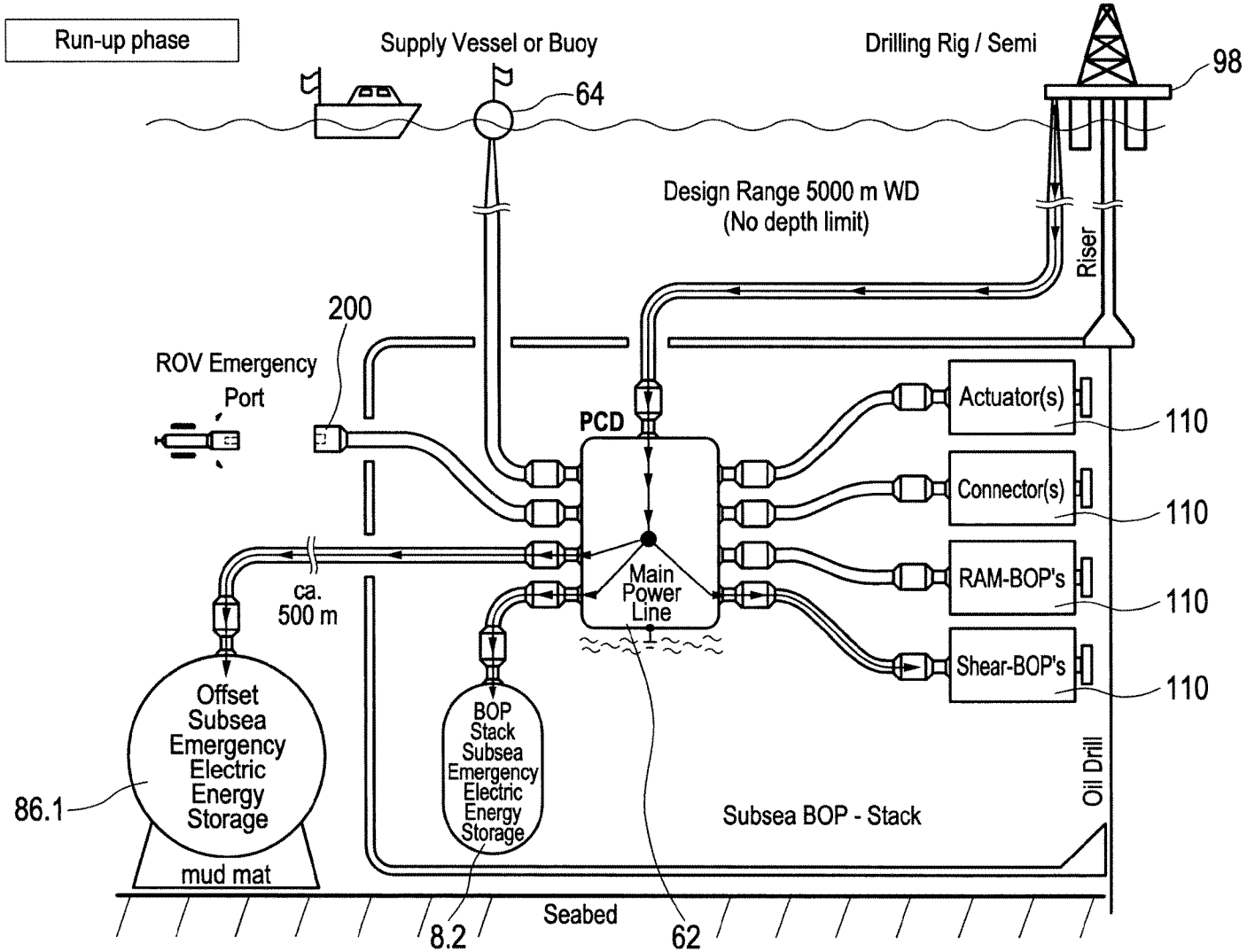
FIG. 5-10 illustrate various modes of operation of the energy supply and control systems.

FIG. 5 illustrates that initially after installation of the blowout preventer stack energy from drilling platform or drilling rig 98 is supplied via power and communication distributer 62 to energy storage devices 86.1 and 86.2 which preferably are steam turbine arrangements. Thus, energy storage devices 86.1 and 86.2 are charged. Further, flywheel energy storage devices 142 at each blowout preventer drive means 110 are charged in that respective centrifugal masses are put into rotation at high-speed.

After all energy storage devices 86.1, 86.2 and 142 are charged, the power and communication distributor 62 switches into a normal operation mode. In this normal operation mode the blowout preventer stack is supplied by drilling platform 98. All energy storage devices are supplied with only very little energy to keep them in a fully charge state.

Figure 6:
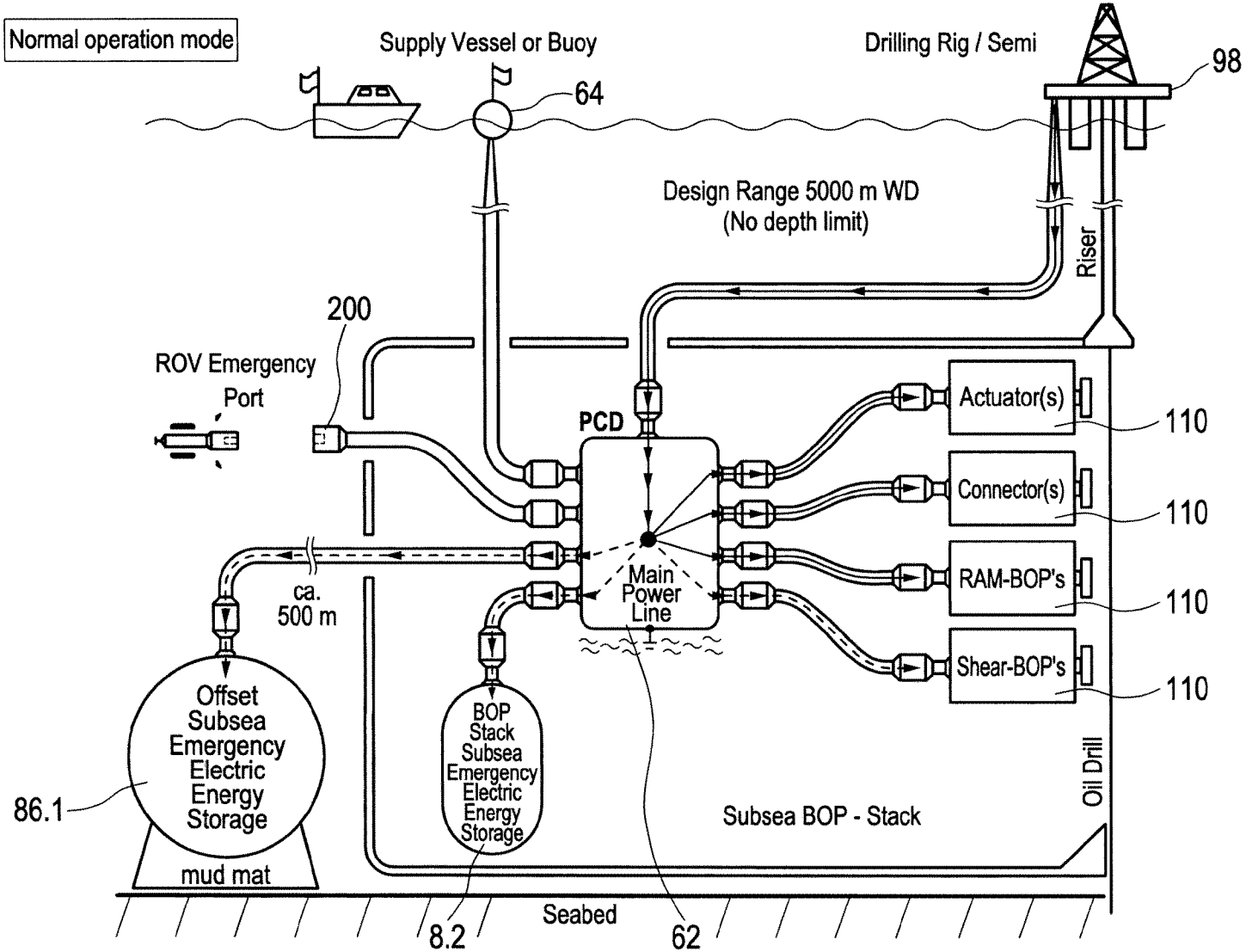
Figure 7:
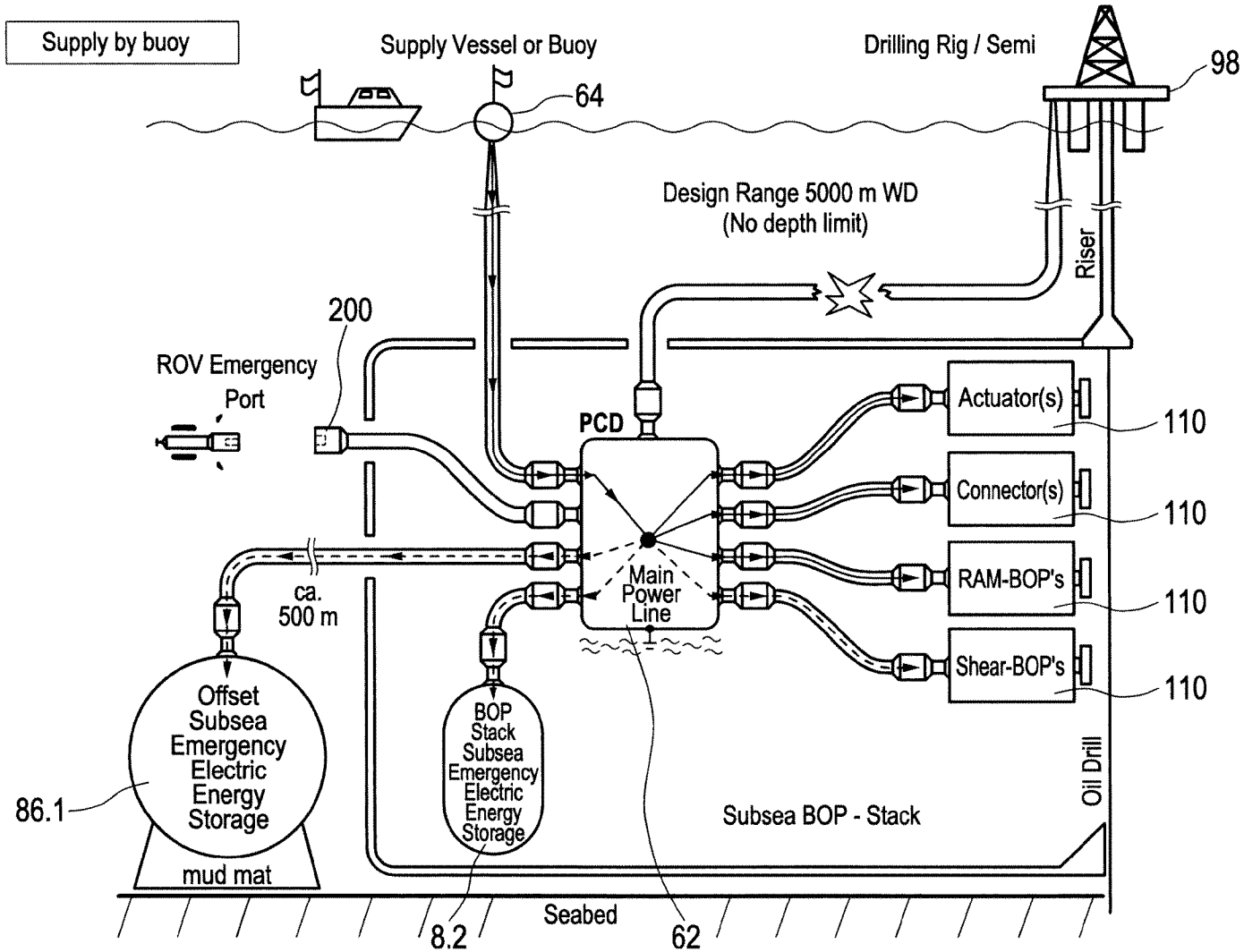

FIG. 6 illustrates that in case of a break of the power supply line between the drilling platform and the power and communication distributors 62, power supply may be provided by means of a supply vessel or buoy 64. Thus, all subsea energy storage devices can maintain their fully charged state.

Figure 8:
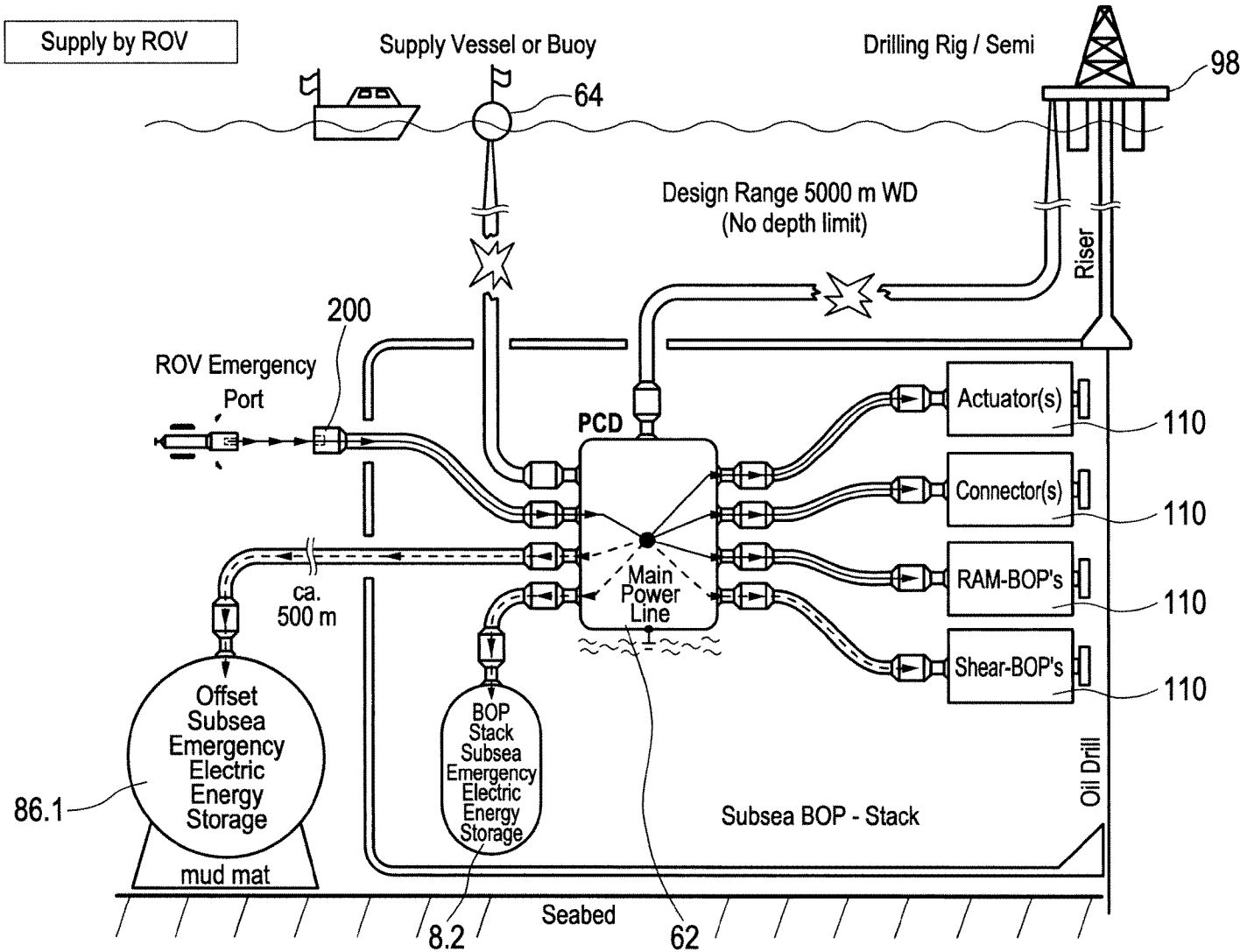

FIG. 8 illustrates that in case both supply lines between the drilling platform 98 and the buoy 64 are interrupted, energy supply may be achieved via the remotely operated vehicle port 200. In such case, all subsea storage devices are supplied with just enough energy to keep them at their fully charge state.

Figure 9:
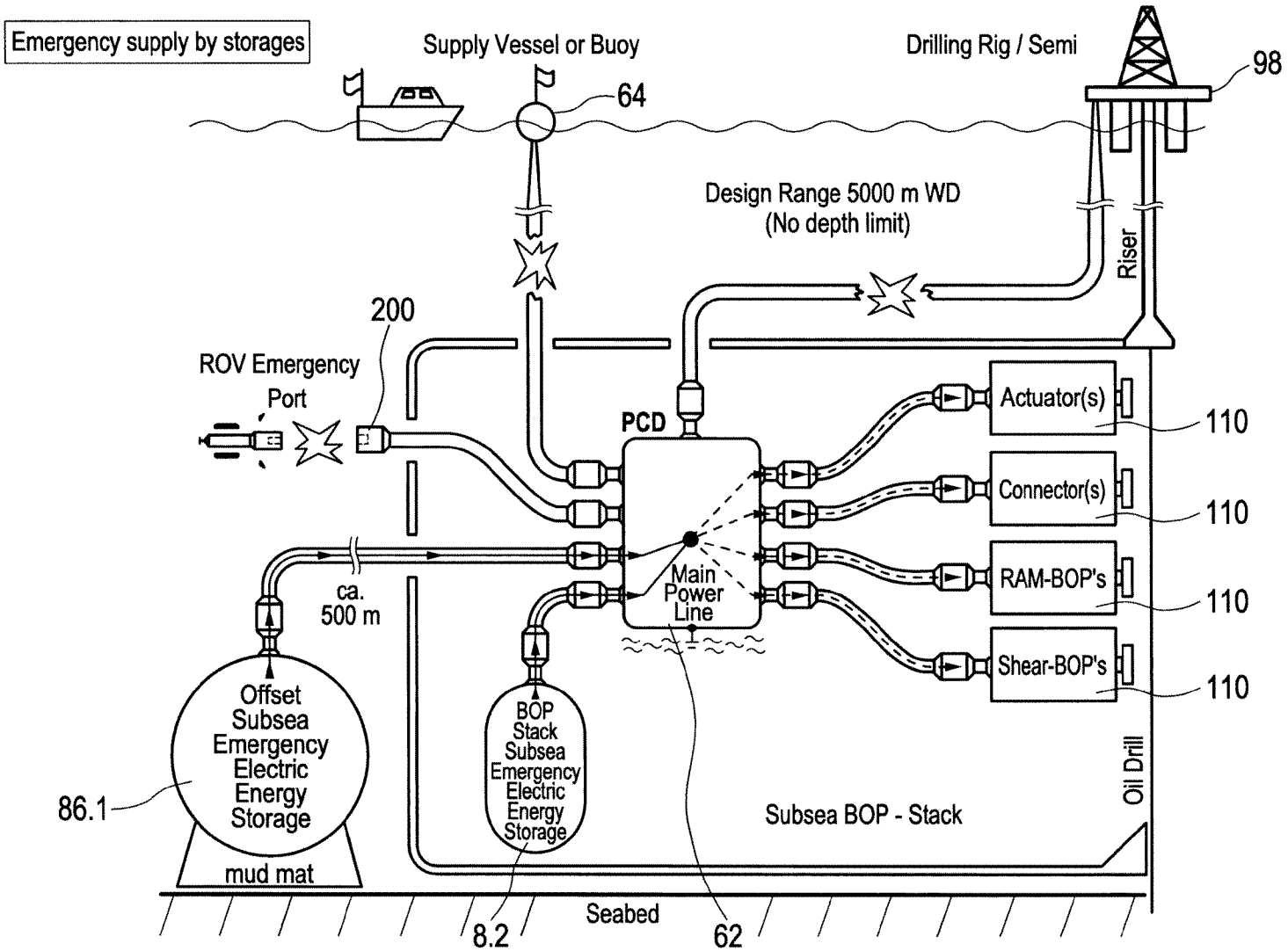
Figure 10:
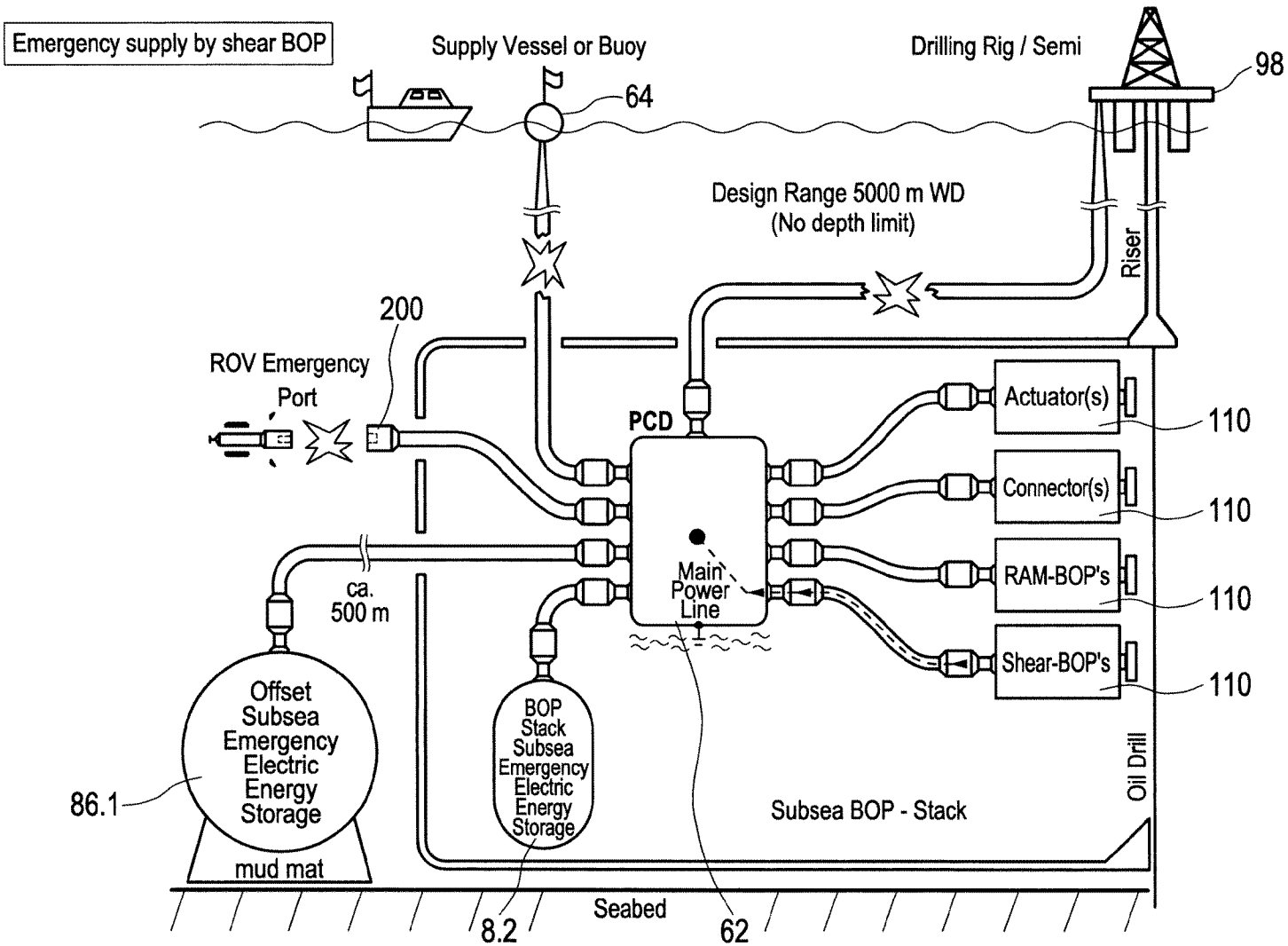
Figure 11:
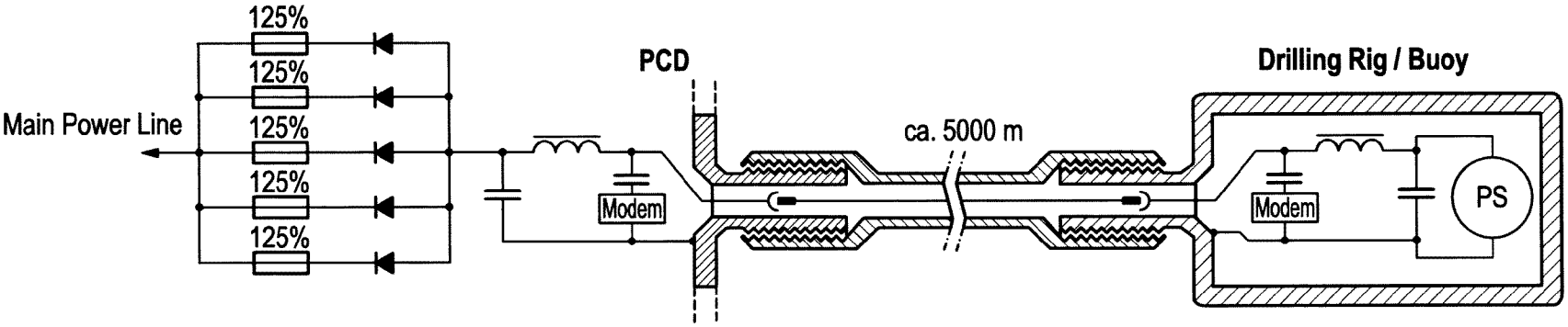
FIGS. 11 to 16 illustrate details of the power and communication distributor including a control unit.
Figure 12:
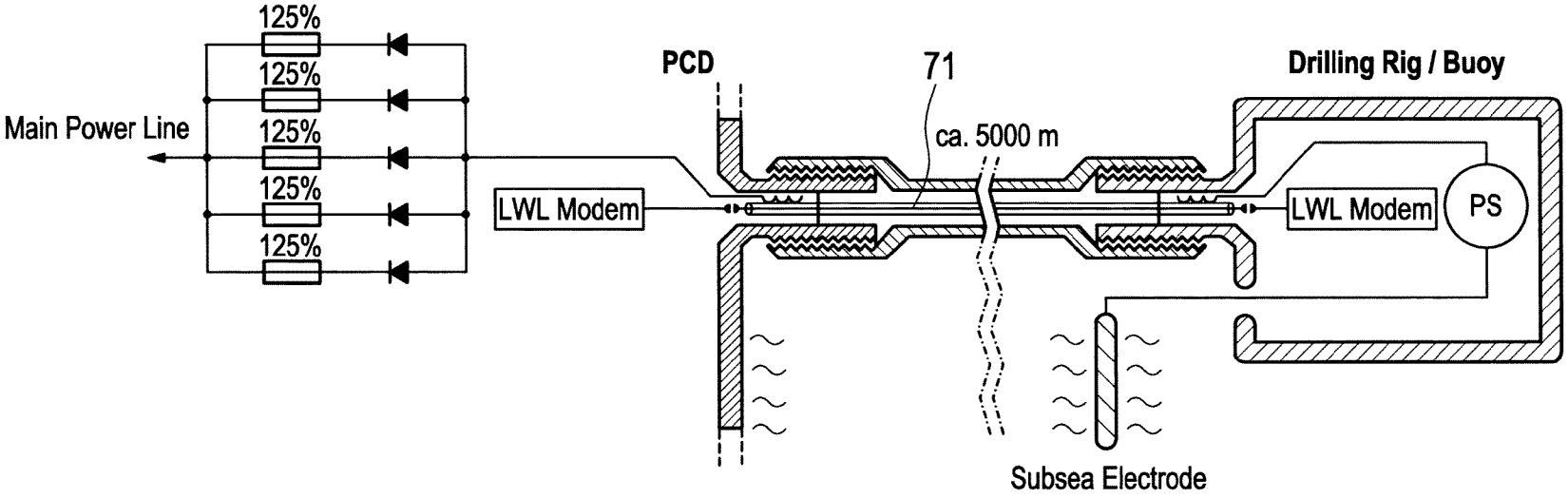
Figure 13:
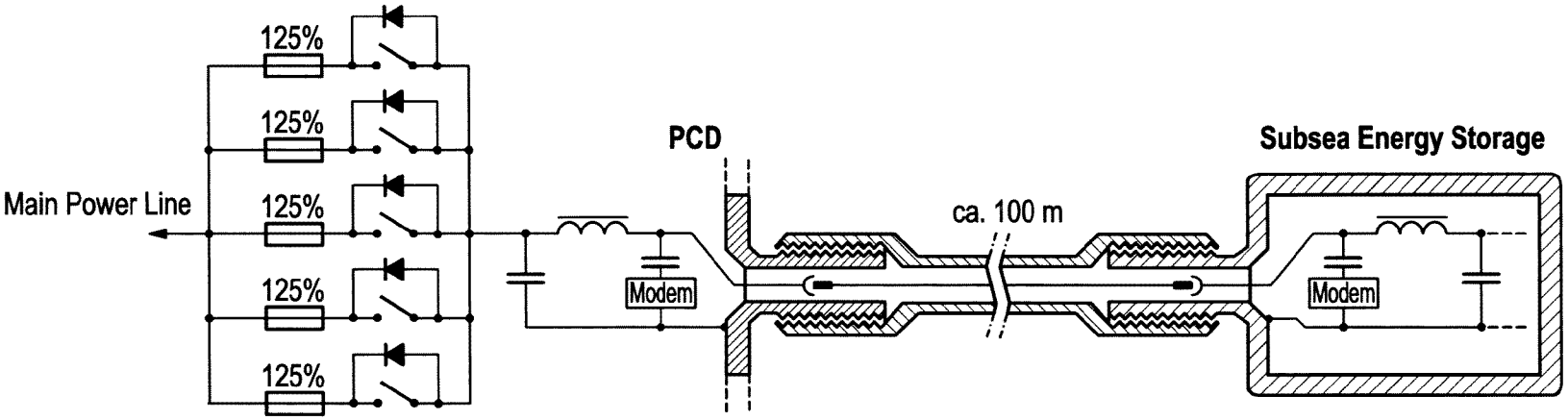
Figure 14:
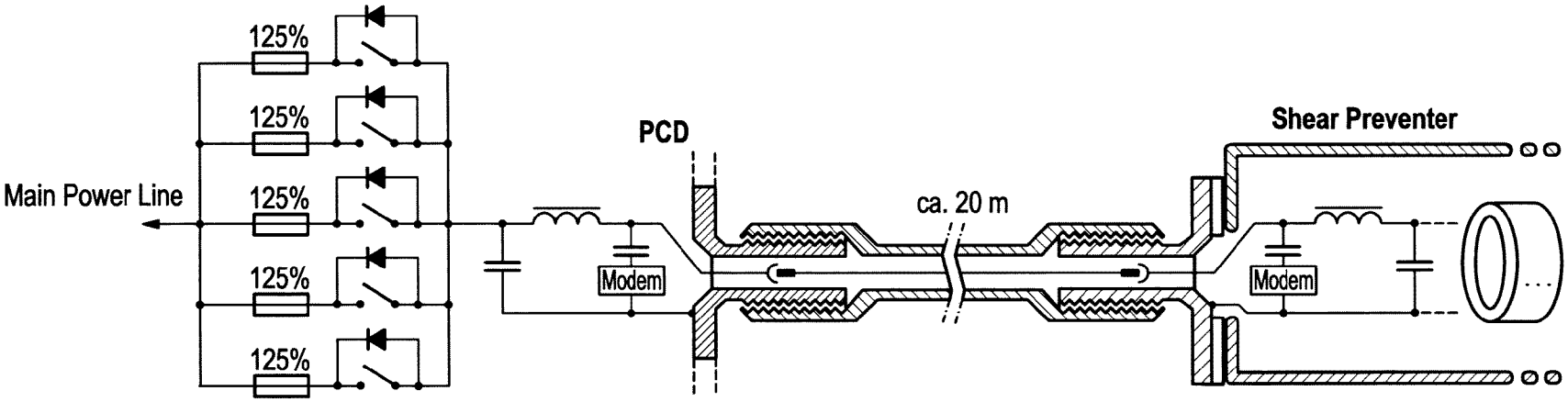
Figure 15:
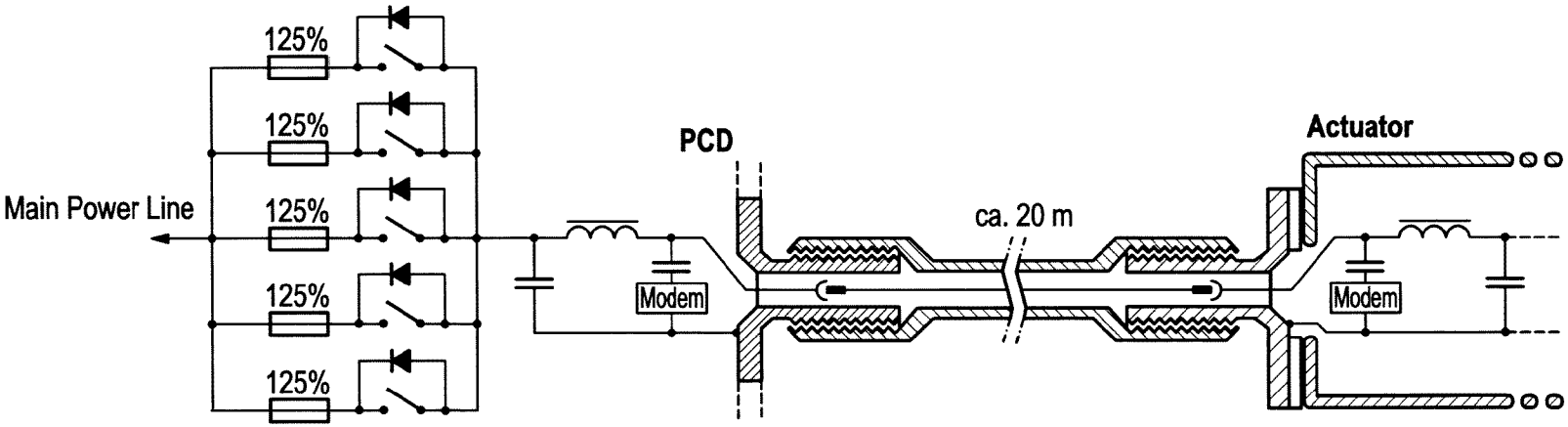
Figure 16:
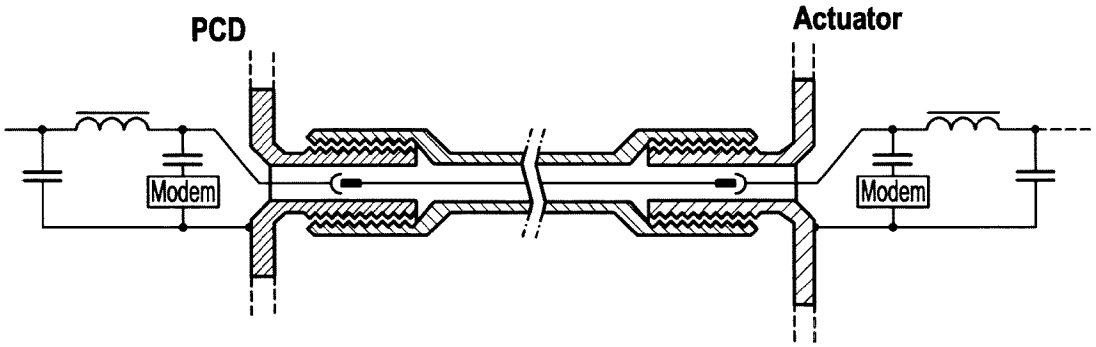

If all ordinary energy supply lines are broken or are interrupted, power and communication distributor 62 switches into emergency mode wherein the subsea energy storage devices 86.1 and 86.2, which are steam turbine arrangements as disclosed in FIGS. 34 to 36, are used to supply the flywheel energy storage devices 142 of blowout preventer drive means 110; cf. FIG. 9.

In case the subsea energy storage devices 86.1 and 86.2 are fully depleted, energy is taken from the flywheel energy storage devices 142 of blowout preventer drive means 110. Flywheel energy storage devices 142 are depleted one after another until even the last flywheel energy storage device 142 is fully discharged. Thus, operation of the power and communication distributor 62 and of motor control units 112 of blowout preventer drive means 110 (cf. FIG. 18) are supplied with energy until no energy is left in the system that could cause any uncontrolled movement of any blowout preventer 20, 40, 44, 54 or 58. Thus control over the blowout preventers stack is maintained until the very last minute before the blowout preventer stack is inoperable at all.

The power and communication distributor 62 comprises a control unit that controls all connected units according to commands received from the drilling platform. In case of an interruption of the connection to the drilling platform 98, power and communication distributor 62 switches into an emergency mode and puts all connected units like blowout preventer drive means 110 in a safe position.

FIGS. 11 to 16 illustrate alternative embodiments of the monopolar or coaxial power supply line 70 including a data communication line 71. As already pointed out with respect to FIG. 2 energy supply line 70 between the drilling platform 98, buoys 64 or 66 or subsea energy storage devices 86 and 94 is preferably monopolar using the sea as the second conductor. Rather than using a multipolar communication cable, data communication between the drilling platform 98 and power and communication distributor 62 is achieved by means of a modem and a single data line 71. In the embodiments of FIGS. 16, 18, 19, 20 and 21, the data is electrically transmitted via a coaxial power supply line whereas in the embodiment of FIG. 17, a data line 71 is a light wave guide.

In the embodiments of FIGS. 16, 18, 19, 20 and 21, polar supply line 70 is a coaxial line and thus allows for electric data communication by an electric modem.

The modem preferably has a data rate of 1 MBps and serves for communication of commands and measured data.

Figure 18:
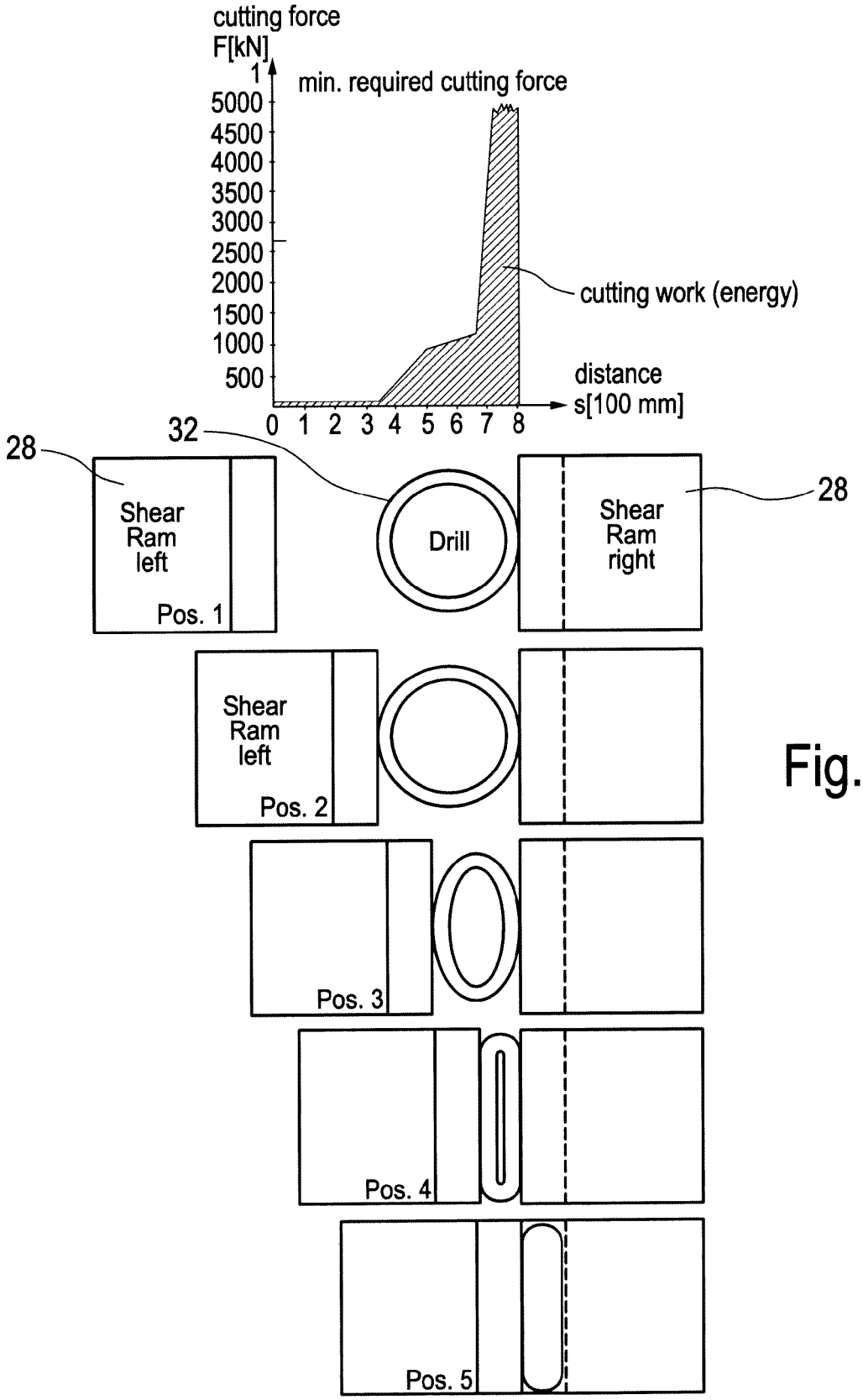
FIG. 18 illustrates the typical forces needed to operate a shear ram.
Figure 19:
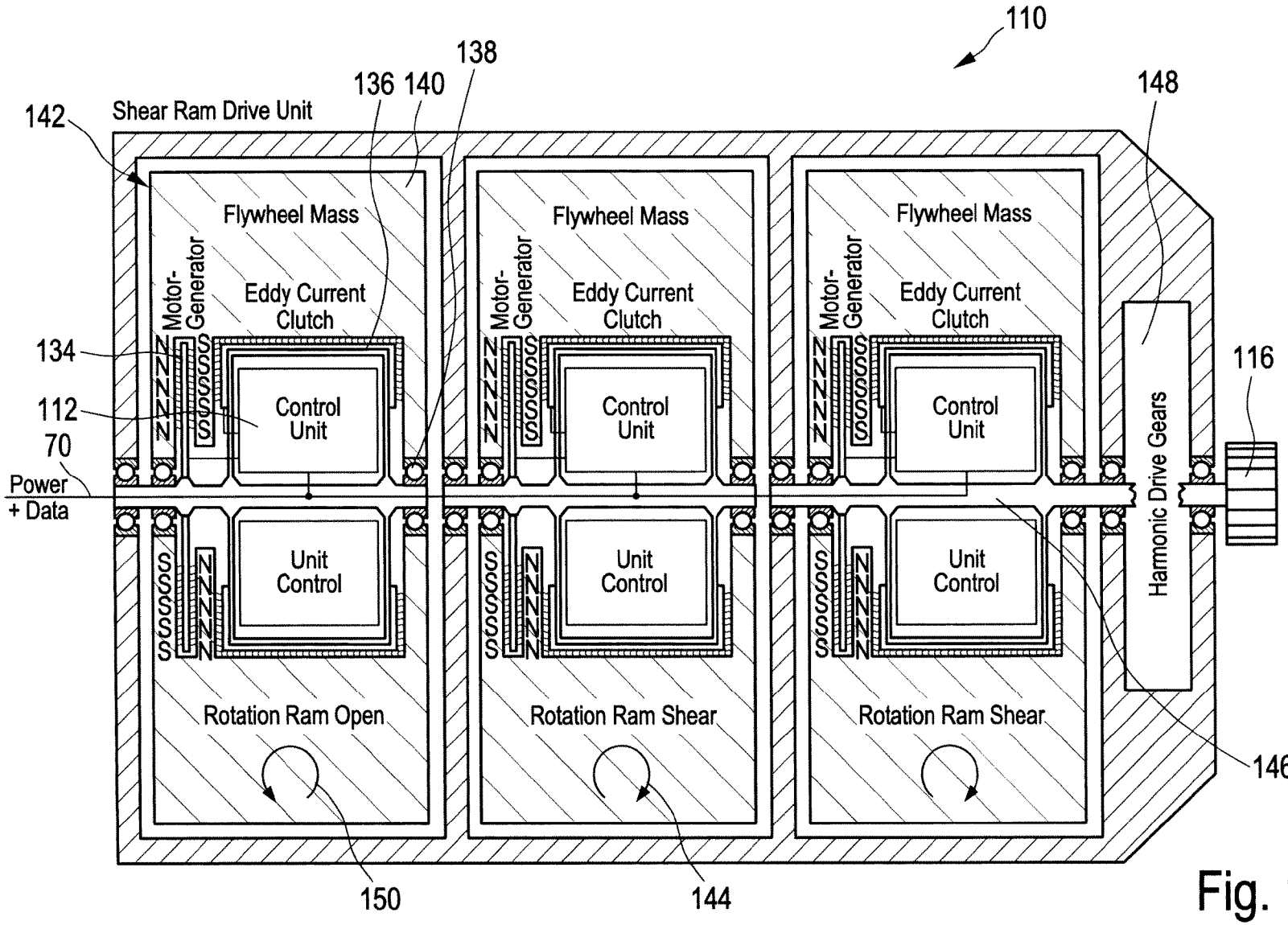
FIG. 19 is a schematic illustration of a first exemplary embodiment of a blowout preventer drive means.
Figure 20:
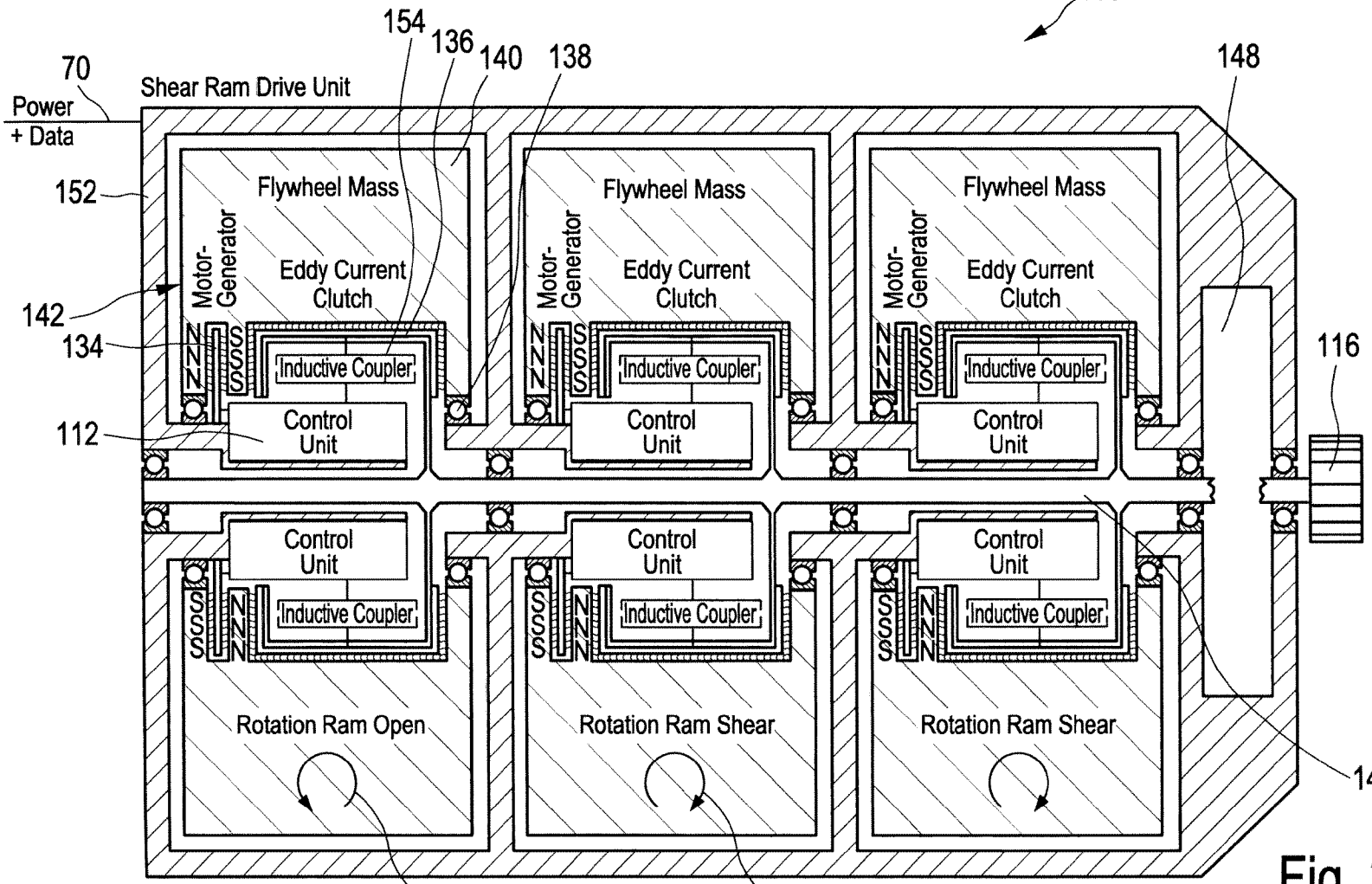
FIG. 20 is a schematic illustration of a second exemplary embodiment of a blowout preventer drive means.

For safety reasons, power is supplied by five parallel lines each line featuring a diode in series with a fuse or other protection device. Each fuse is dimensioned for a quarter of the supply power. Thus, failure of one diode would cause the complete power to pass the respective fuse which thus would blow. Alternatively, as illustrated in FIGS. 18, 19 and 20, additional switches parallel to each diode could be provided at those power supply lines that connect the power and communication distributor 62 with either subsea energy storage 86 or flywheel energy storage device 141. By means of the switches, the energy storage devices can be charged.

Figure 17:
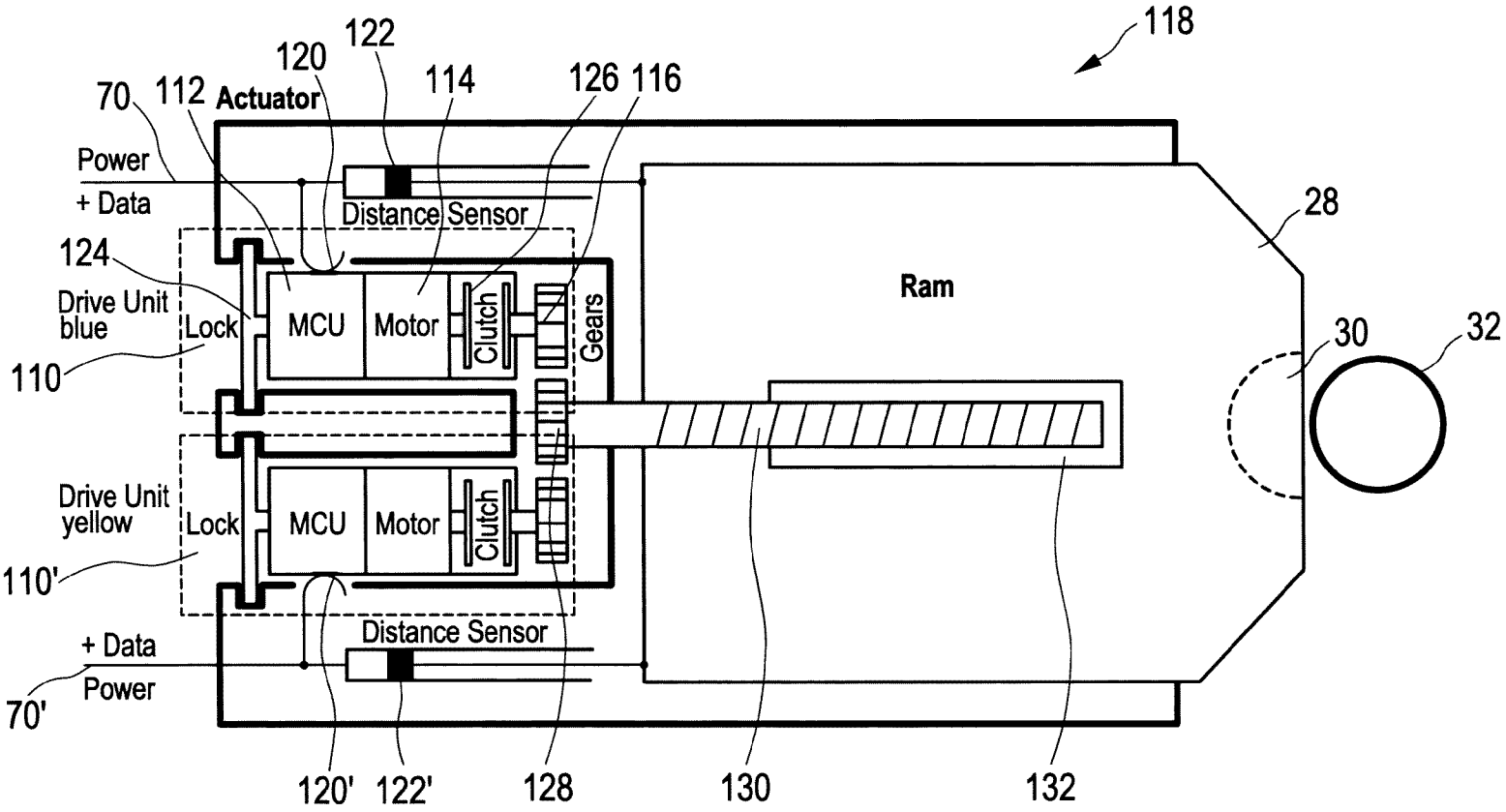
FIG. 17 is a schematic illustration of an exemplary embodiment of a blowout preventer stack component in the form of a pipe ram blowout preventer with connected blowout preventer drive means.

FIG. 17 shows a schematic illustration of a pipe ram blowout preventer 118, as it is used for example in the blowout preventer stack 10 as pipe ram blowout preventers 20, 40 or 44. The blowout preventer 118 is connected by means of the monopolar line 70 to the energy supply and control system Blue 12 and by means of the monopolar line 70' to the energy supply and control system Yellow 14. The monopolar line 70 supplies the blowout preventer drive means 110 by means of a sliding contact 120 with electric energy and can exchange data signals with the blowout preventer drive means 110 by means of the sliding contact 120. Further, the monopolar line 70 is connected to a position sensor 122, which is adapted to measure the position of the ram 28 of the blowout preventer 118 and to generate a position data signal, which comprises position data of the ram 28. The position data signal can be transmitted by means of the monopolar line 70 to the energy supply and control system 12. Instead of a position sensor 122 or in addition to it, the blowout preventer 118 can also include a pressure sensor and/or force sensor for measuring a pressure or a force which acts on the ram 28. The force sensor can be particularly used for "snubbing" in order to reduce the material wear of the rams 28 of the blowout preventers 118.

A redundant second blowout preventer drive means 110 and a redundant second position sensor 122' are connected to the energy supply and control system Yellow 14 by means of a monopolar line 70'. The blowout preventer 118 thus includes a redundant system, which can operate the blowout preventer 118 if the other system should not be operational. The blowout preventer 118 can also include for example four blowout preventer drive means, of which preferably one pair is connected to the energy supply and control system Blue 12 and another pair to the energy supply and control system Yellow 14. Further redundant blowout preventer drive means are also possible.

The blowout preventer drive means 110 is fixed to the body of the blowout preventer 118 by means of a closure device 124. The closure device 124 can be unlocked in order to change the blowout preventer drive means 110. This is particularly possible underwater and while the blowout preventer 118 is in operation, for example by means of a remotely operated underwater vehicle—ROV. During the change of the blowout preventer drive means 110, the blowout preventer drive means 110' can take over the operation of the blowout preventer 118, so that continuous operation of the blowout preventer 118 is ensured.

Besides the closure device 124, the blowout preventer drive means 110 comprises the motor control unit 112, which is adapted to control the motor 114 and further components of the blowout preventer drive means 110. For that purpose, the motor control unit 112 can receive control signals from the microcontroller unit 74 of the energy supply and control system Blue 12, which can be transmitted to the motor control unit 112 by means of the monopolar line 70. The motor 114 is connectable to a self-locking gear wheel 116 by means of an electromechanical positively locking coupling 126. If the motor 114 is connected to the self-locking gear wheel 116 by means of the coupling 126, the self-locking gear wheel 116 transmits a torque from the motor 114 to a ram gear wheel 128, which actuates a roller spindle 130 for the purpose of either closing or opening the ram 28 by screwing the roller spindle 130 into a ram thread 132 or by screwing it out of same. Disengagement of the motor 118 from the self-locking gear wheel 116 by means of the electromechanical positively locking coupling 126 makes it possible to keep the motor 114 continuously in operation, particularly if the ram 28 of the blowout preventer 118 is not to be moved. That ensures that the motor 114 is ready for operation at any time to make it possible for the ram 28 of the blowout preventer 118 to capable of being moved.

FIG. 18 illustrates the typical forces needed to operate a shear ram. Initially, until both rams 28 contact the pipe, the force need is very low. Thereafter, the force needed to drive a ram 28 increases slowly while the pipe is deformed. Finally (see FIG. 18, position 5) the strongest force is needed to cut the pipe.

FIG. 19 shows details of a first embodiment of a blowout preventer drive means 110. The monopolar line 70 supplies the blowout preventer drive means 110 with energy and allows for the transmission of data from and to the energy supply and control system Blue 12. For that purpose, the monopolar line 70 is connected to the motor control units 112. The motor control units 112 are connected to motor generator pulleys 134 and an eddy current coupling 136, respectively. Arranged in a cylindrical space around the motor control units 112, the motor generator pulleys 134 and the eddy current couplings 136, are centrifugal masses 140 mounted by rotary bearing 138 are arranged. In this embodiment, the centrifugal masses 140 are disc-shaped and made of iron. The centrifugal masses 140 may also be of another form, for example flywheel form, oscillating cylinder form, swing bar form or the like, and be made of another metallic material or comprise one or a plurality of metallic materials. The rotary bearings 138 can for example be ball bearings or magnetic rotary bearings in order to reduce the friction and wear of the centrifugal masses 140.

The motor generator pulleys 134 are adapted to accelerate the centrifugal masses 140 by supplying the motor generator pulleys 134 of the motor control units 112 with electric current or to slow them down by operating the motor generator pulleys 134 as a generator, whereby electric current is generated in the motor generator pulleys 134. The centrifugal mass 140 serves thus as a flywheel energy storage device 142, which is charged with electric energy and stores said electric energy in kinetic energy, i.e. the flywheel energy storage device 142 is a kinetic energy storage device. Since the flywheel energy storage device 142 can again convert the kinetic energy being stored in it by means of the motor generator pulley 134 back into electric energy, the flywheel energy storage device 142 thus serves as motor-generator-combination.

For operating a blowout preventer 118 in a first direction, for example as a forward drive 144, the torque rotating in clockwise direction of the flywheel energy storage device 142 can be transmitted to a shaft 146 by means of the eddy current couplings 136. The shaft 146 is connected by means of a coupling and self-locking device 148 to the self-locking gear wheel 116 and can drive said self-locking gear wheel. The self-locking gear wheel 116 drives the ram gear wheel 128 by means of the clockwise-rotating torque of the ram gear wheel 128 such that the roller spindle 130 screws into the ram thread 132 and thereby closes the ram 28 (see FIG. 3).

For opening the ram 28, a counterclockwise rotating torque of another flywheel energy storage device 142 is used. The reverse drive 150 produced thereby rotates the self-locking gear wheel 116 counterclockwise, which transmits the counterclockwise torque to the ram gear wheel 128. The ram gear wheel 128 thereby unscrews the roller spindle 130 from the ram gear wheel 128, thereby causing opening of the ram 28 (see FIG. 3).

In the illustrated embodiment, two of the flywheel energy storage devices 142 serve as a forward drive 144 and one flywheel energy storage device 142 as a reverse drive 150. The forward drive 144 requires a higher torque for closing the rams 28, because jetting liquid, suspension and/or a drill rod 32 may be present between the rams 28, which drill rod must possibly be cut through in order to close the rams 28. More than three flywheel energy storage devices 142 can also be arranged in a blowout preventer drive means 110. Preferably, more flywheel energy storage devices 142 are provided for a forward drive 144 than for a reverse drive 150.

The motor control units 112 are further adapted to measure the rotational speed of the flywheel energy storage devices 142 and to transmit it as a data signal to the energy supply and control system Blue 12. The flywheel energy storage devices 142 in this embodiment are adapted to be continuously operated at approximately 10,000 to 12,000 rpm in order to be able to drive the rams 28 of the blowout preventer 118 at any time. From the rotational speed it is possible to evaluate the energy stored in the respective flywheel energy storage device 142, which is available to operate the blowout preventer 118. The flywheel energy storage devices 142 designed as a motor-generator combination can recuperate electric energy and transmit said electric energy in form of electric power to other flywheel energy storage devices 142, particularly also to other blowout preventer stack components.

FIG. 20 shows details of a second embodiment of a blowout preventer drive means 110. The monopolar line 70 is in this case connected to a housing 152 of the blowout preventer drive means 110. The housing 152 is made of steel, however, it can be also made of another conductive material. By means of the housing 152 and the monopolar line 70, the motor control unit 112 is connected to the energy supply and control system Blue 12. The motor control unit 112 controls the motor generator pulley 134 and is connected to the eddy current coupling 136 by means of an inductive coupling 154. Similarly to the embodiment of FIG. 4, a centrifugal mass 140 mounted by means of rotary bearings is arranged in a cylindrical space around the motor control unit 112, the motor generator pulley 134, the inductive coupling 154 and the eddy current coupling 138.

In contrast to the embodiment of FIG. 4, however, the shaft 146 in the embodiment of FIG. 5 is only connected to the eddy current coupling 136. The motor control units 112 and the motor generator pulleys 134 are fixedly connected to the housing 152. A torque stored in form of kinetic energy can be transmitted at any time from the centrifugal masses 140 of the flywheel energy storage devices 142 to the shaft 146 by means of the eddy current coupling 136. In that case, the shaft 146 can be operated in the form of a forward drive or reverse drive by means of the eddy current coupling 136. In this case also the self-locking gear wheel 116 can receive a torque via a coupling and self-locking device 148 by means of the shaft 146 for driving therewith the ram gear wheel 128, which screws the roller spindle 130 into or unscrews it out of the ram thread 132.

A purely hydraulic shear ram blowout preventer requires that more than five times the energy needed to deformed cut the pipe must be stored in a hydraulic pressure storage device. In contrast thereto, a flywheel energy storage device only that amount of energy must be stored that is finally needed to cut the pipe.

Figure 21:
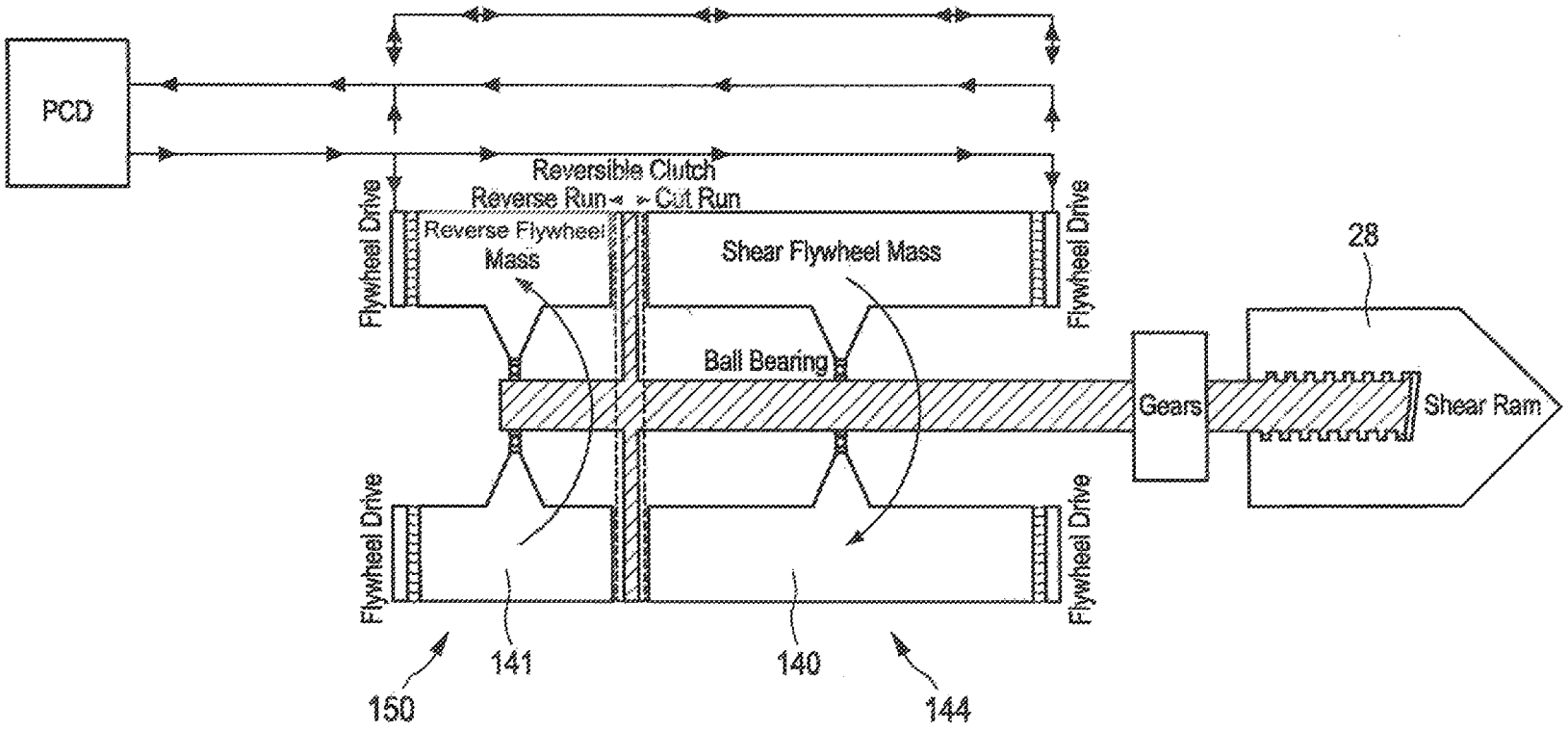
FIG. 21 illustrates that the flywheel energy storage device comprises two centrifugal masses.
Figure 22:
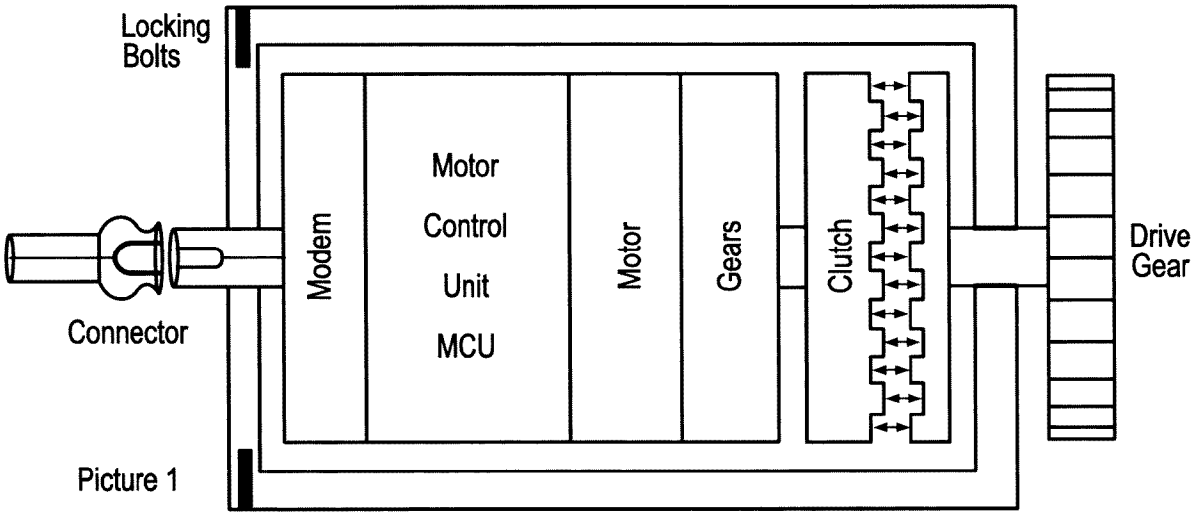
FIGS. 22 to 26 illustrate various embodiments of blowout preventer drive means using mechanical clutches and a mechanical gear.
Figure 23:
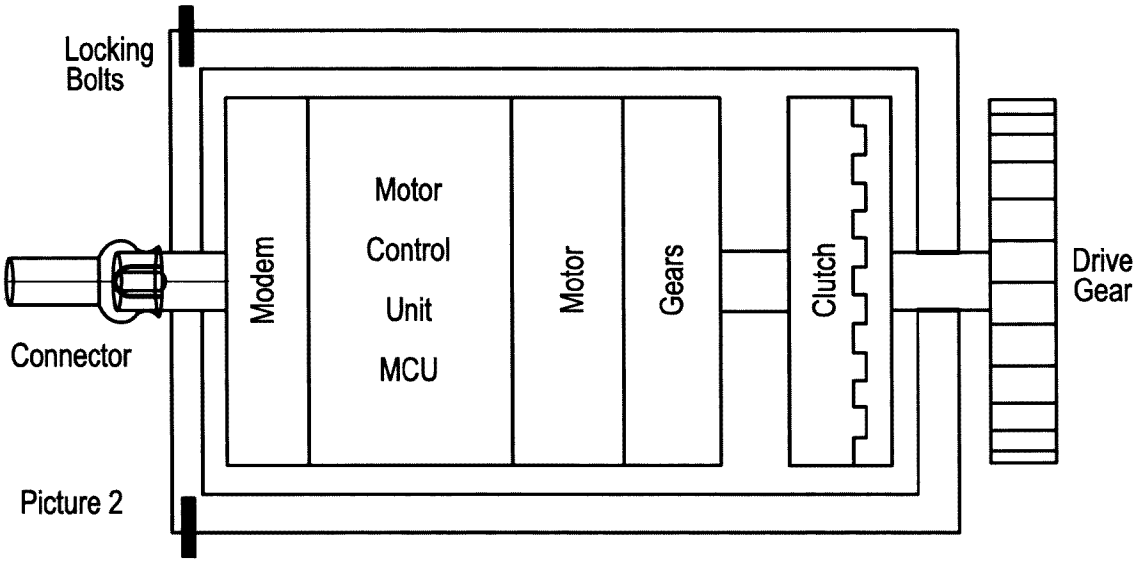
Figure 24:
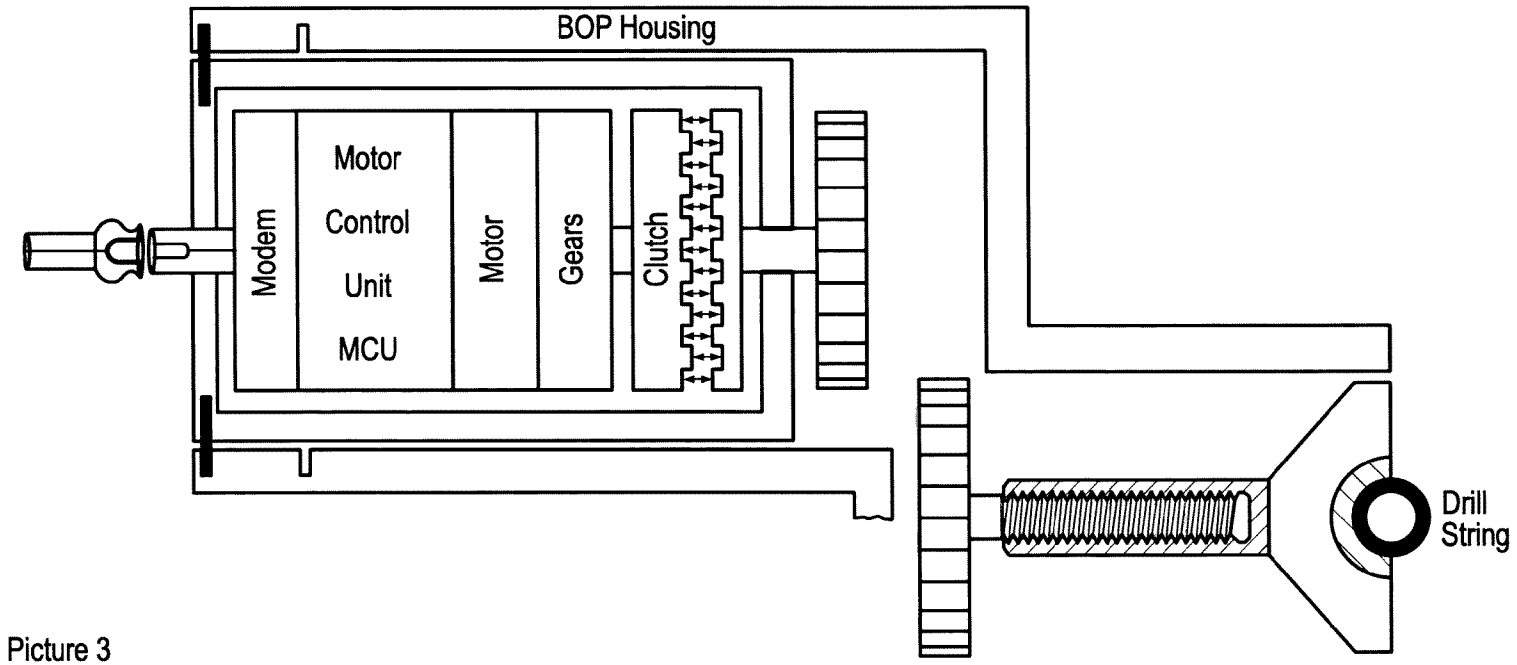
Figure 25:
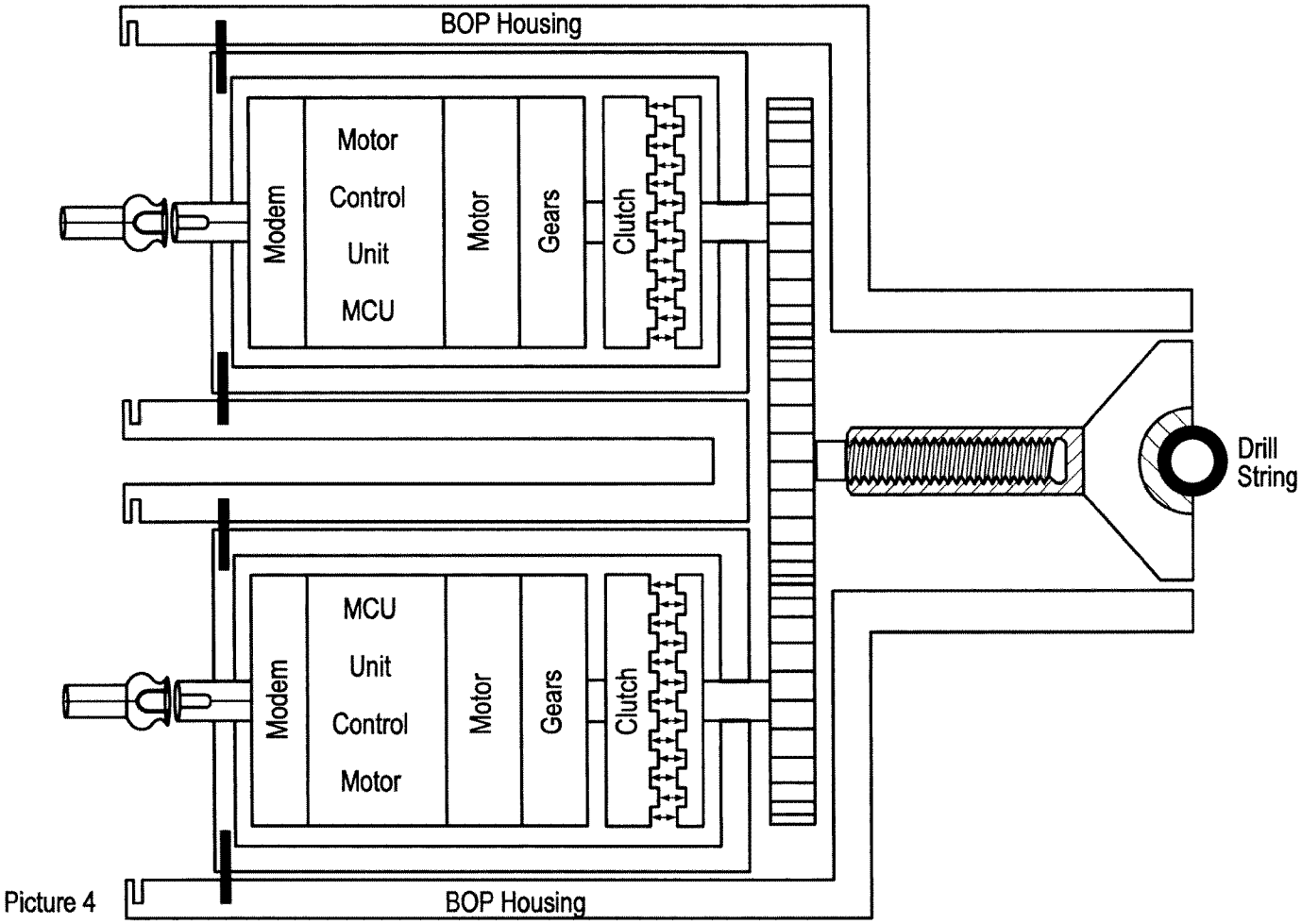
Figure 26:
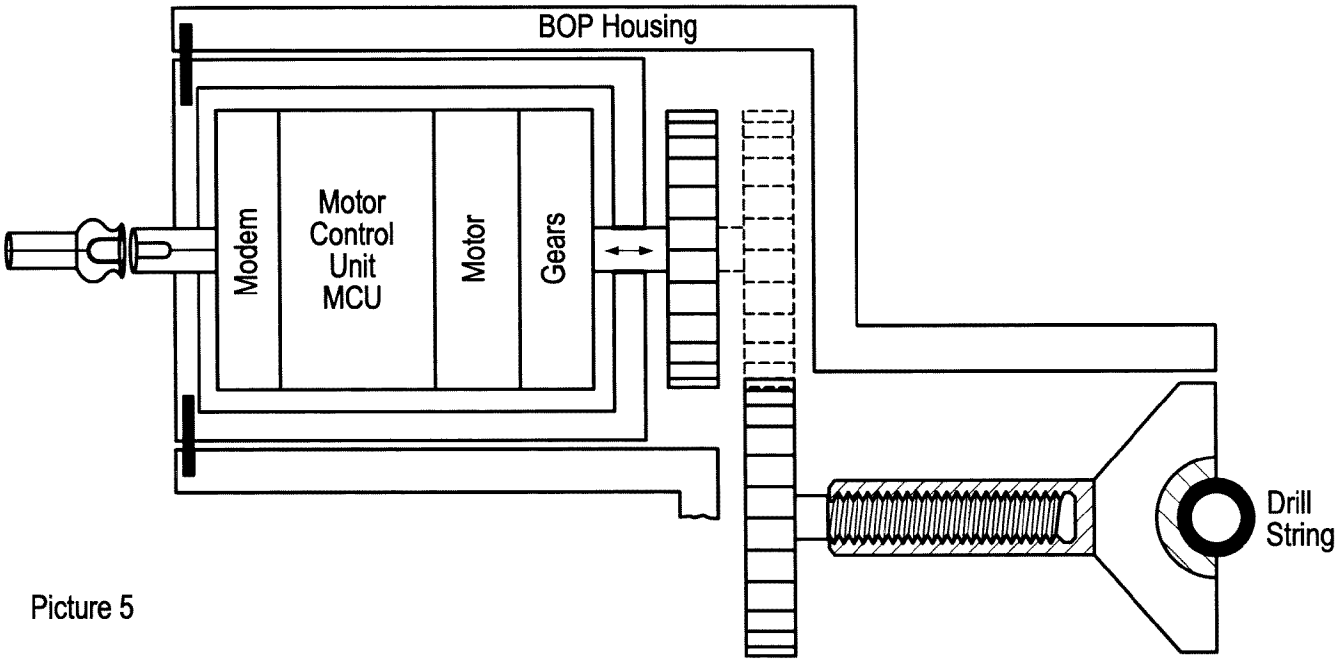

FIG. 21 illustrates that the flywheel energy storage device comprises two centrifugal masses, shear flywheel mass 140 and reverse flywheel mass 141. The shear flywheel mass 140 is used to cause the forward movement of shear ram 28 whereas the reverse flywheel mass 141 can be used to retract shear ram 28.

FIGS. 22 to 26 illustrate various embodiments of blowout preventer drive means 110 using mechanical clutches 126 and a mechanical gear. The embodiment of FIG. 29 closely corresponds to the embodiment illustrated in FIG. 17.

Figure 27:
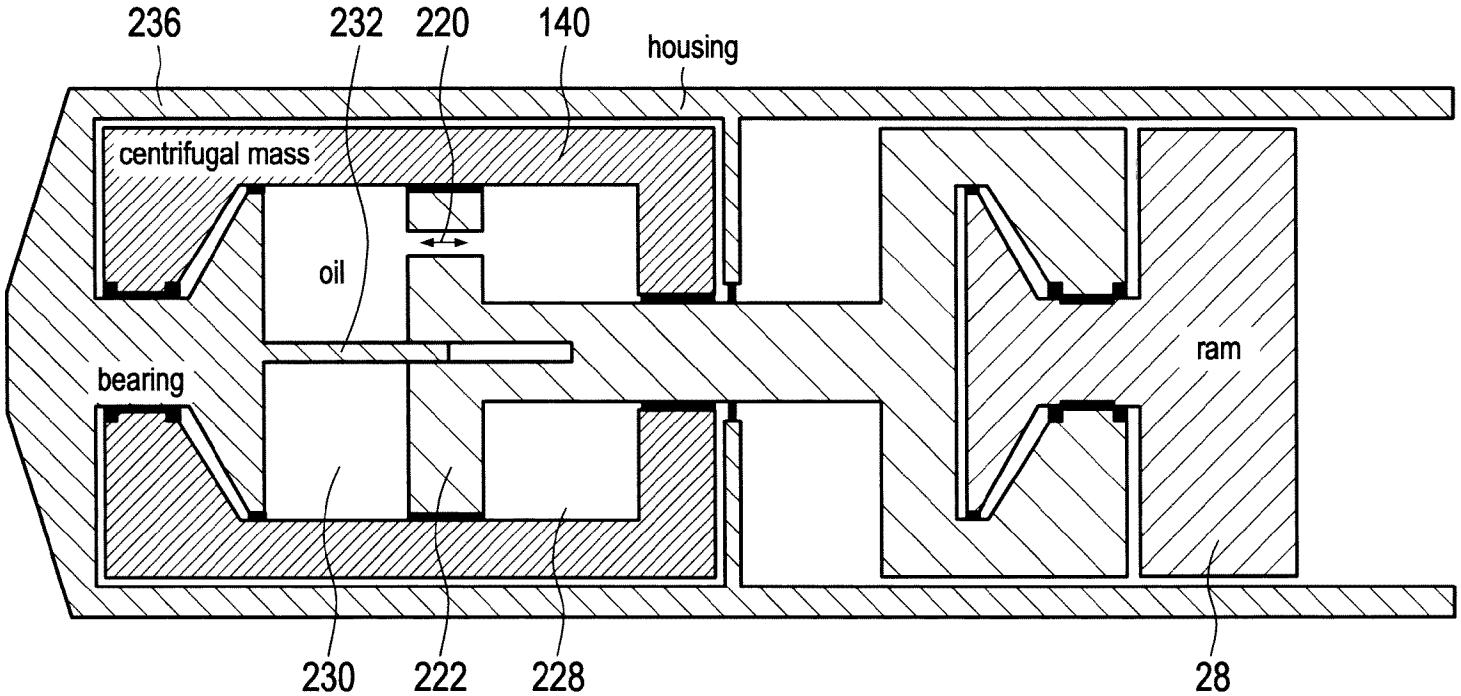
FIGS. 27 and 28 illustrate an alternative embodiment of a blowout preventer drive means.
Figure 28:
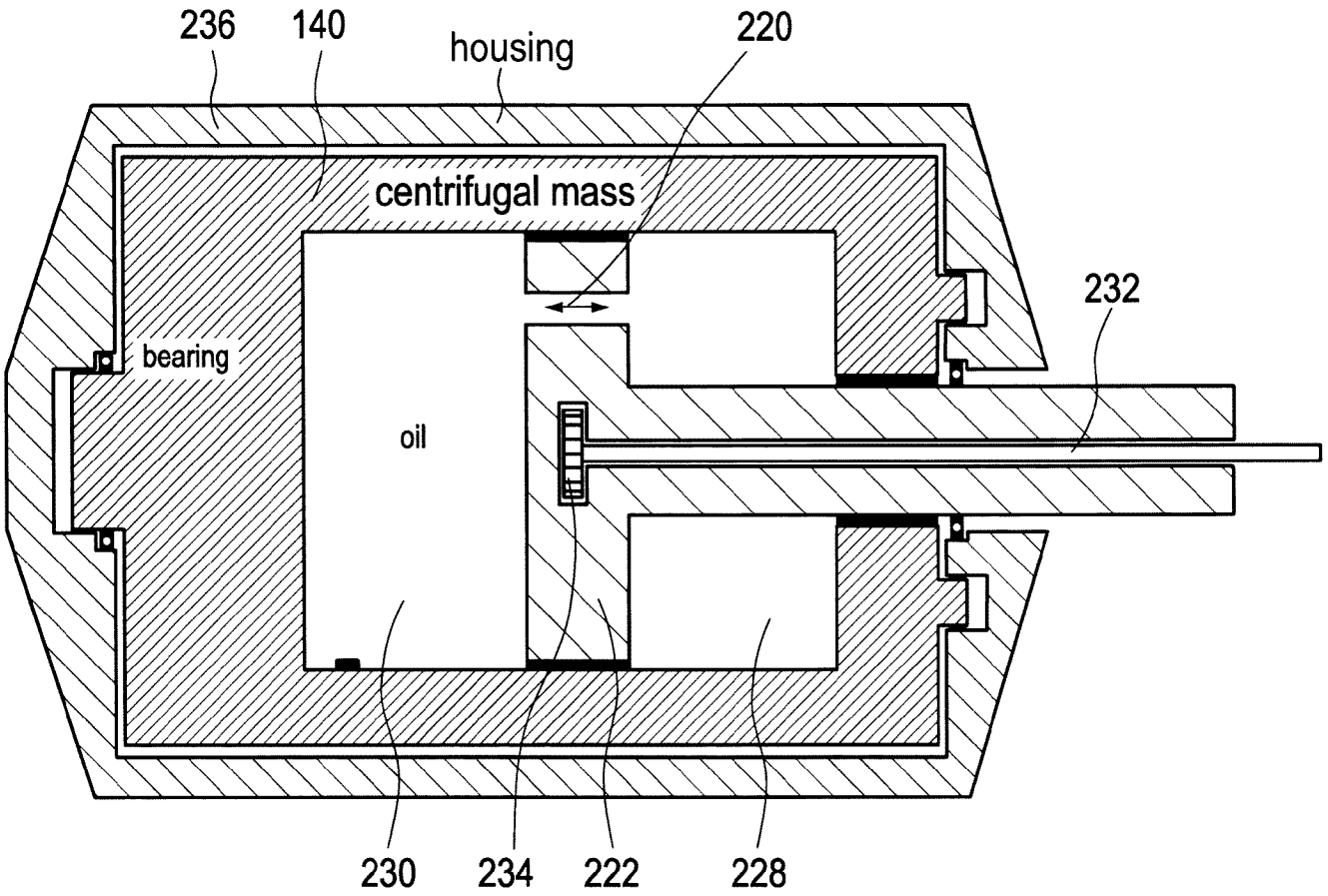

FIGS. 27 and 28 illustrate an alternative embodiment of a blowout preventer drive means wherein the flywheel mass or centrifugal mass 140 directly acts on a hydraulic pump 220 connected to a piston 222 within an hydraulic cylinder 224 that is in encased by centrifugal mass 140. Rotation of the centrifugal mass 140 is used to mechanically drive pump 120 and to thus cause pump 220 to pump hydraulic fluid 226 (e.g. oil) from a first chamber 228 of cylinder 224 to a second chamber 230 or the other way around. Pumping of the hydraulic fluid causes piston 222 to move within cylinder 224 and thus to drive ram 28. Thus, driving of shear ram 28 is possible without a mechanical clutch or a mechanical gear.

Centrifugal mass 140 rotates about an axis 232 that may hold the gear wheel 234 or other mechanical means in place and which provides for the counter force of the mechanical drive for pump 220. Axis 232 can be either fixed to housing 236 of blowout preventer drive means 110 (see FIG. 27) or to the shear ram (see FIG. 28).

Centrifugal mass 140 can be accelerated in the same way as illustrated with respect to FIG. 19.

Figure 29:
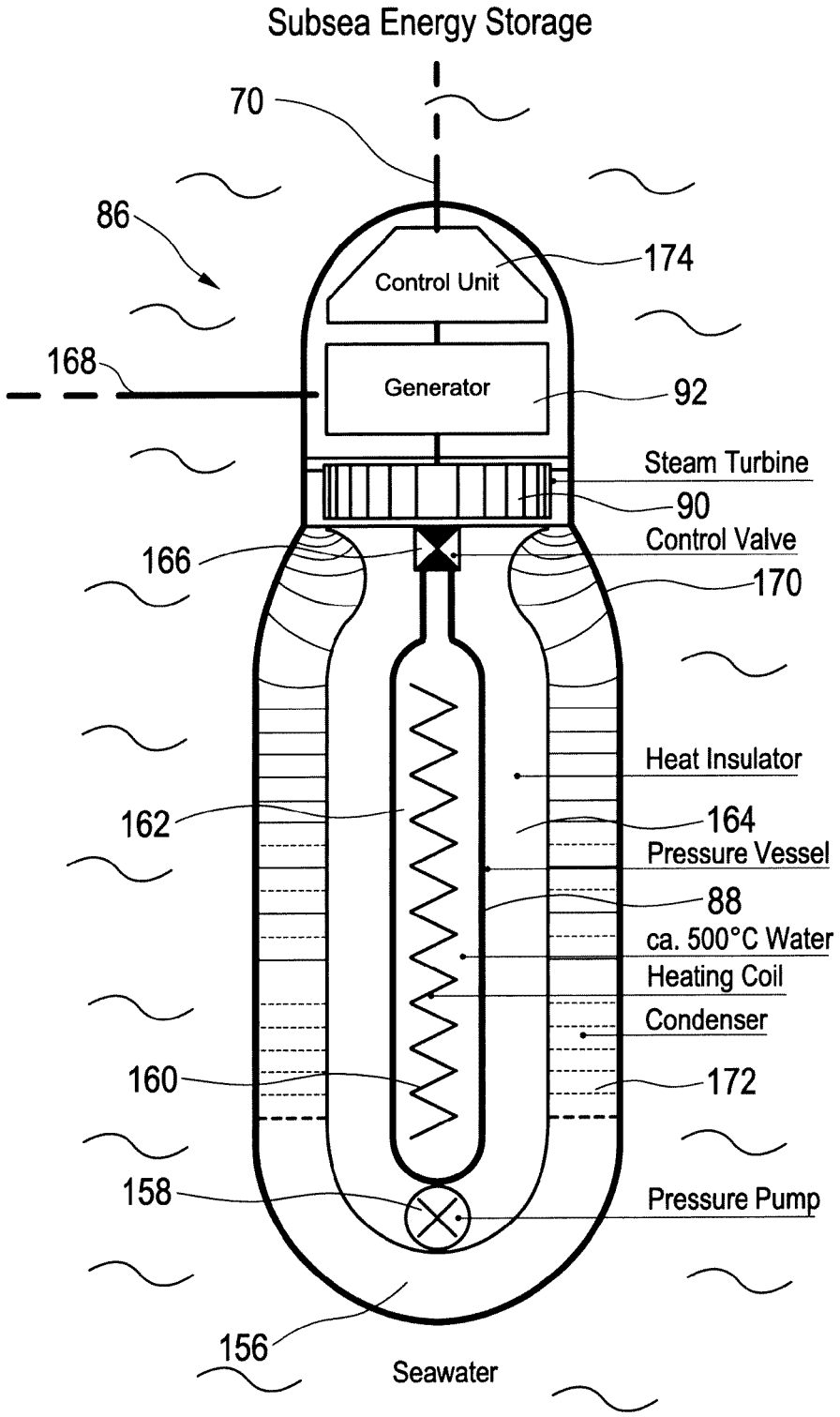
FIG. 29 is a schematic illustration of an exemplary embodiment of a steam turbine arrangement.

FIG. 29 shows details of an embodiment of a steam turbine arrangement 86. Present in the lower section of the steam turbine arrangement 86 is water 156 which can be pumped into the steam accumulator 88 by means of a pressure pump 158. In the steam accumulator 88, hot pressurized steam 162 is generated from water by means of a heating element 160. In order not to lose unnecessary energy stored in the temperature of the steam 162, the steam accumulator 88 is enclosed by an insulation 164. The steam 162 is continuously heated by means of the heating element 160 in order to constantly keep the steam 162 at a high temperature and high pressure. During operation of the steam turbine arrangement, i.e. if an emergency energy supply is necessary, a steam valve 166 is opened, which allows the steam 162 from the steam accumulator 88 to do work at the steam turbine 90, whereby electric energy is generated in a generator 92 connected to the steam turbine 90. The current generated in such a manner in the generator 92 can be fed by means of a line 168 to a blowout preventer stack 10 or to a blowout preventer stack component in order to operate them. The steam 162 condenses at the cool outer wall 170 and by means of a condenser 172 into water and accumulates in the lower section of the steam turbine arrangement 86.

At its upper end, the steam turbine arrangement 86 is connected to a monopolar line 70 which leads to the energy supply and control system Blue 12. The monopolar line 70 transmits electric energy and data signals to a steam installation control unit 174. The heating element 160 is supplied with electric energy in the form of electric current by means of the steam installation control unit 174, whereby the heating element 160 does not impose any demands as to the quality of the electric current being fed to it. In particular, the heating element 160 can be supplied with electric current generated by means of a diesel generator on the drilling platform 98. The steam installation control unit 174 controls the pressure pump 158, the heating element 160 and the steam valve 166. By means of a thermo element, for example a thermometer or the like, the temperature and thus also the energy stored in the steam can be determined (not shown). The steam accumulator 88 in this embodiment is adapted to have continuously stored sufficient energy for closing, opening and again closing a blowout preventer 118, particularly the shear ram blowout preventer 52, at any time. The steam accumulator can also have stored more energy, for example to be able to operate a plurality of blowout preventers.

Figure 30:
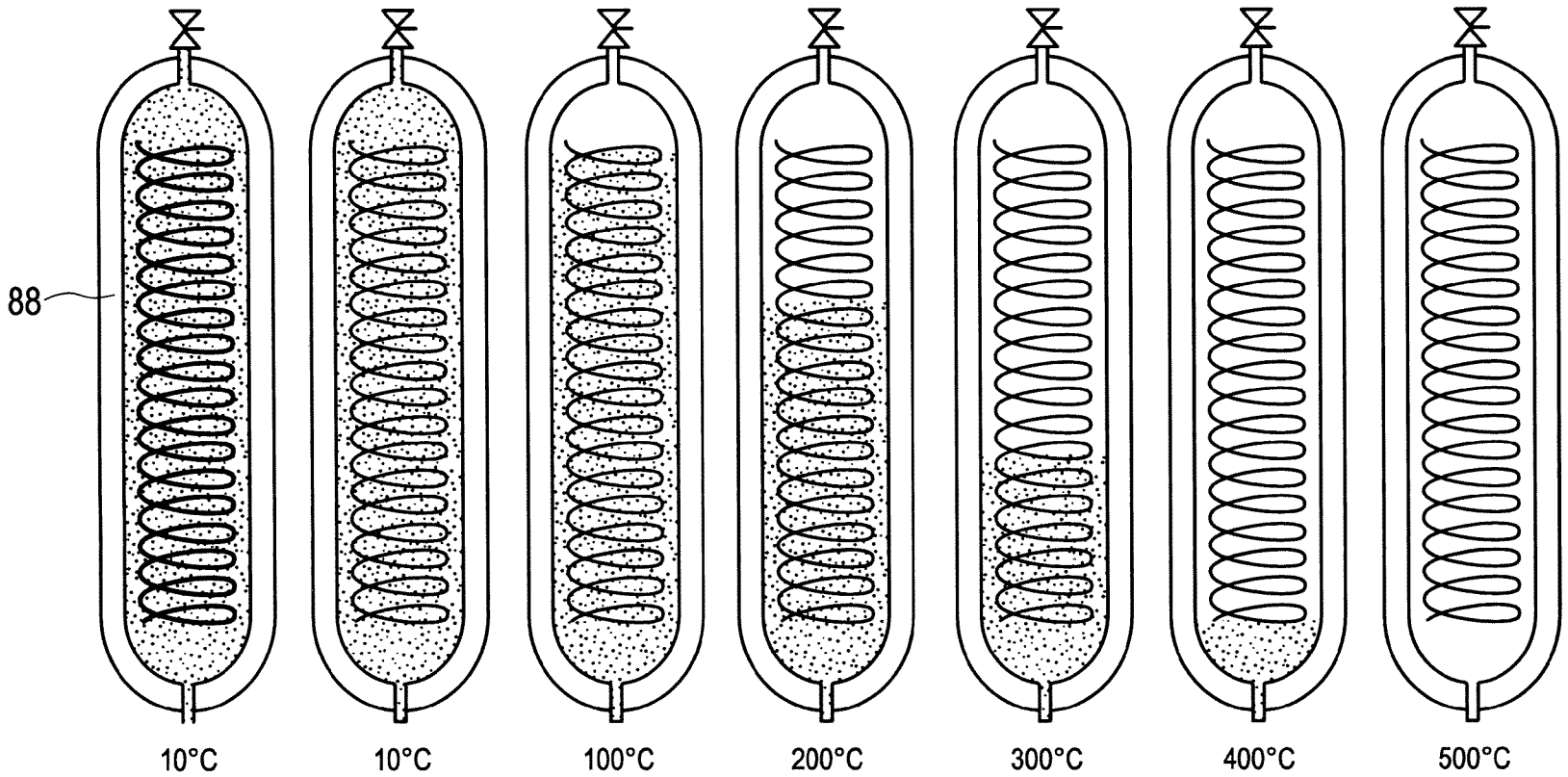
FIG. 30 illustrates the charging of subsea energy storage device.

FIG. 30 illustrates the charging of subsea energy storage device 86. Initially, energy storage device 86 is fully discharged. Charging is performed by electrically heating the water within steam accumulator 88.

LIST OF REFERENCE NUMERALS

10 Blowout preventer stack
12 Energy supply and control system Blue
14 Energy supply and control system Yellow
16 Wellhead
18 Wellhead Connector
20 Lower pipe ram blowout preventer
22 First interspace
24 Choke Valve
26 Choke Line
28 Ram
30 Cut-out
32 Drill (string (pipe)
34 Second interspace
36 Kill valve
38 Kill line
40 Middle pipe ram blowout preventer
42 Third interspace
44 Upper pipe ram blowout preventer
46 Fourth interspace
48 Valve control unit Yellow
50 Valve control unit Blue
52 Shear ram blowout preventer
54 Lower annular blowout preventer
56 Riser connector
58 Upper annular blowout preventer
60 Lower marine riser package—LMRP
62 Control unit, Power and communication distributor
64 Emergency energy supply and emergency control system Blue
66 Emergency energy supply and emergency control system Yellow
70 Monopolar supply line
71 Data communication line
72 Microprocessor unit
74 Microcontroller unit
76 Energy source
78 Microprocessor unit Yellow
80 First microcontroller unit Yellow
82 Second microcontroller unit Yellow
84 Control unit Yellow

86 Steam turbine arrangement Blue
88 Steam accumulator
90 Steam turbine
92 Generator
94 Steam turbine arrangement Yellow
96 Pressure-tight steel pipe
98 Drilling platform
100 Switch control unit
102 Switches
104 Overcurrent protection device
106 Connector
108 Connector contact
110 Blowout preventer drive means
112 Motor control unit
114 Motor
116 Gear wheel
118 Blowout Preventer
120 Sliding contact
122 Position sensor
124 Closure device
126 Coupling
128 Ram gear wheel
130 Roller spindle
132 Ram thread
134 Motor generator pulley
136 Eddy current coupling
138 Rotary bearing
140 Centrifugal mass
141 Reverse flywheel mass
142 Flywheel energy storage device
144 Forward drive
146 Shaft
148 Coupling and self-locking device
150 Reverse drive
152 Housing
154 Inductive coupling
156 Water
158 Pressure pump
160 Heating element
162 Steam
164 Insulation
166 Steam valve
168 Line
170 Outer wall
172 Condenser
174 Steam installation control unit
200 Remotely operated vehicle energy port (ROV emergency port)
220 Pump
222 Piston
224 Cylinder
228 First chamber
230 Second chamber
232 Axis
234 Gear wheel
236 Housing

The invention claimed is:

1. A blowout preventer stack, comprising a blowout preventer stack component with a blowout preventer and an electric blowout preventer drive means for operating the blowout preventer, said electric blowout preventer drive means having a kinetic energy storage device comprising a centrifugal mass, said electric blowout preventer drive means further having an electric motor for rotating the centrifugal mass, wherein energy for operating the blowout preventer is provided by the kinetic energy storage device, and wherein the blowout preventer drive means can operate the blowout preventer directly by kinetic energy from the kinetic energy storage device.

2. The blowout preventer stack according to claim 1, wherein at least two blowout preventer drive means for independently operating a blowout preventer are connected to a respective blowout preventer.

3. The blowout preventer stack according to claim 2, wherein at least one of the two blowout preventer drive means is exchangeable while the blowout preventer stack is in operation.

4. The blowout preventer stack according to claim 1, wherein the blowout preventer stack is configured so that the blowout preventer stack component of the blowout preventer stack is operable all-electric.

5. The blowout preventer stack according to claim 1, wherein the blowout preventer stack is connected to at least two independent energy supply and control systems, which are operable independently of one another and adapted to supply the blowout preventer components of the blowout preventer stack with energy and to transmit data signals for measuring parameters and for controlling the blowout preventer stack component and to receive data signals from the blowout preventer stack component.

6. The blowout preventer stack according to claim 1, wherein the blowout preventer stack is connected by an emergency cable to an emergency energy supply and emergency control system, wherein the emergency energy supply and emergency control system is adapted to supply the blowout preventer stack component of the blowout preventer stack by the emergency cable with energy and to transmit data signals for measuring parameters and for controlling the blowout preventer stack component of the blowout preventer stack to the blowout preventer component and to receive data signals from the blowout preventer stack component.

7. The blowout preventer stack according to claim 1, wherein the blowout preventer is provided with more than one kinetic energy storage device, each comprising a centrifugal mass, and wherein one of the kinetic energy storage devices is adapted to store energy and transmit the energy to at least one other kinetic energy storage device or the blowout preventer drive means and/or receive the energy from the at least one other kinetic energy storage device or the blowout preventer drive means.

8. The blowout preventer stack according to claim 1, wherein the blowout preventer comprises a force and/or position sensor adapted to measure force and/or position data and provide the force and/or the position data as a data signal.

9. The blowout preventer stack according to claim 1, wherein the kinetic energy storage device includes a magnetic material.

10. The blowout preventer stack according to claim 1, wherein the blowout preventer stack component of the blowout preventer stack is connected to at least two overcurrent protection devices such that a first overcurrent protection device is arranged between a line portion at an energy supply system side and a connector to the blowout preventer stack component, and a second overcurrent protection device is arranged between the connector and the blowout preventer stack component, wherein the overcurrent protection devices are adapted to interrupt the current conduction in the event of an excessively high current.

11. The blowout preventer stack according to claim 1, wherein the electric blowout preventer drive means for operating the blowout preventer includes at least two kinetic energy storage devices, each comprising a centrifugal mass.

12. A method for operating a blowout preventer drive means of a blowout preventer stack according to claim 11, wherein of the at least two kinetic energy storage devices at least one kinetic energy storage device is rotated in one direction, and of which at least one other kinetic energy storage device is rotated in an opposite direction, so that at least one of the kinetic energy storage devices can be used as a forward drive and at least another of the kinetic energy storage devices can be used as a reverse drive.

13. The blowout preventer stack according to claim 1, wherein the blowout preventer stack comprises an upper annular blowout preventer, a riser connector, a lower annular blowout preventer, a shear ram blowout preventer, a pipe ram blowout preventer and a wellhead connector.

14. A blowout preventer stack, comprising a blowout preventer stack component with a blowout preventer and an electric blowout preventer drive means for operating the blowout preventer, said electric blowout preventer drive means having a kinetic energy storage device comprising a centrifugal mass, said electric blowout preventer drive means further having an electric motor for rotating the centrifugal mass, wherein energy for operating the blowout preventer is provided by the kinetic energy storage device, and wherein the blowout preventer drive means can operate the blowout preventer directly by kinetic energy from the kinetic energy storage device, and wherein the centrifugal mass comprising a flywheel.

15. The blowout preventer stack according to claim 14, wherein the centrifugal mass directly acts on a hydraulic pump connected to a piston within a hydraulic cylinder that is encased by the centrifugal mass.

16. The blowout preventer stack according to claim 15, wherein energy supply and control systems, which are adapted to supply the blowout preventer stack component of the blowout preventer stack with energy and to transmit data signals for measuring parameters and for controlling the blowout preventer stack component of the blowout preventer stack to the blowout preventer stack component and to receive data signals from the blowout preventer stack component, are connected to the blowout preventer stack by a monopolar line.

17. A blowout preventer stack, comprising a blowout preventer stack component with a blowout preventer and an electric blowout preventer drive means for operating the blowout preventer, said electric blowout preventer drive means having a kinetic energy storage device comprising a centrifugal mass, said electric blowout preventer drive means further having an electric motor for rotating the centrifugal mass, wherein energy for operating the blowout preventer is provided by the kinetic energy storage device, and wherein the blowout preventer drive means can operate the blowout preventer directly by kinetic energy from the kinetic energy storage device, wherein the blowout preventer stack is also operatively connected to at least one steam turbine arrangement, and wherein a steam accumulator of the steam turbine arrangement is adapted to continuously generate and/or receive steam, which is provided as energy for operating at least one blowout preventer of the blowout preventer stack.

* * * * *